US011392068B2

(12) United States Patent
Saito et al.

(10) Patent No.: US 11,392,068 B2
(45) Date of Patent: Jul. 19, 2022

(54) IMAGE FORMING APPARATUS

(71) Applicant: CANON KABUSHIKI KAISHA, Tokyo (JP)

(72) Inventors: Tohru Saito, Shizuoka (JP); Yoshiro Saito, Shizuoka (JP); Akihiko Uchiyama, Shizuoka (JP); Tomoaki Nakai, Shizuoka (JP); Kenta Kamikura, Kanagawa (JP); Yuzo Seino, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/391,244

(22) Filed: Aug. 2, 2021

(65) Prior Publication Data

US 2022/0043381 A1 Feb. 10, 2022

(30) Foreign Application Priority Data

Aug. 4, 2020 (JP) ..... JP2020-132155

(51) Int. Cl.
*G03G 15/20* (2006.01)
*G03G 15/09* (2006.01)

(52) U.S. Cl.
CPC ..... *G03G 15/2057* (2013.01); *G03G 15/0907* (2013.01); *G03G 15/2039* (2013.01); *G03G 15/2064* (2013.01)

(58) Field of Classification Search
None
See application file for complete search history.

(56) References Cited

U.S. PATENT DOCUMENTS 10,114,337 B2 10/2018 Honke
2021/0026263 A1* 1/2021 Uchiyama ..... G03G 9/0823

FOREIGN PATENT DOCUMENTS

JP 2003122151 A 4/2003
JP 5267998 B2 * 8/2013 ..... G03G 15/0808
JP 2016191824 A 11/2016
JP 2017090841 A 5/2017
JP 2018025668 A 2/2018

* cited by examiner

*Primary Examiner* — Sevan A Aydin
(74) *Attorney, Agent, or Firm* — Rossi, Kimms & McDowell LLP

(57) ABSTRACT

In an image forming apparatus, a fixing member has a surface layer having conductivity. A developer is a toner having a toner particle including a binder resin, a reactant of a polyhydric acid and a compound containing a group 4 element is present on a surface of the toner particle, and Tv/Fv>100 is satisfied where Tv represents a volume resistivity upon being unfixed, and Fv represents a volume resistivity after fixing. A bias applying unit can selectively apply a bias of a positive polarity and a bias of a negative polarity, and applies a bias of the same polarity as the charged polarity of a filler included in a recording material when the recording material passes through a fixing nip portion, and when the recording material does not pass through the fixing nip portion, respectively.

10 Claims, 6 Drawing Sheets

IMAGE FORMING APPARATUS

BACKGROUND OF THE INVENTION

Field of the Invention

The present invention relates to an image forming apparatus such as a laser printer or a copier for transferring a toner image formed an image bearing member onto a transfer material using an electrophotographic system, or the like, thereby obtaining a recorded image.

Description of the Related Art

Conventionally, there has been known an image forming apparatus for applying a bias to a fixing apparatus for the purpose of preventing a defective offset image of a toner, or other purposes. As the fixing bias, a bias with such a polarity as to generate an electric field in the direction to hold down an unfixed toner image on a recording material is applied. For example, it is configured such that a negative-polarity unfixed toner image is applied with a negative bias of the same polarity as that of the toner on the side of a fixing film as a fixing member to be in contact with the unfixed toner image (or, a positive bias of the opposite polarity to that of the toner is applied to the side of a pressure roller as a pressure member).

However, the materials for use as a paper filler of a recording material include materials which tend to be charged, and have mutually different polarities. For example, heavy calcium carbonate (calcium carbonate manufactured by grinding/classifying limestone), light calcium carbonate (calcium carbonate manufactured by chemical reaction and synthesis) and titanium dioxide tend to be positively charged. On the other hand, talk, kaolin clay, white carbon, and the like tend to be negatively charged. However, although Chalk which is another kind of calcium carbonate is negatively charged, the ores of heavy calcium carbonate in Japan for use in a filler are all of Calcite type, and hence are positively charged.

For this reason, the dust such as the filler charged to the opposite polarity to that of the toner (e.g., calcium carbonate charged positively with respect to a negative toner) or a paper powder containing the filler may be deposited on the surface of the fixing member due to the fixing bias to be applied to the fixing apparatus. It is known that deposition of such dust causes image defect and toner contamination. In order to deal with this problem, with the image forming apparatus disclosed in Japanese Patent Application Publication No. 2016-191824, a fixing bias with the opposite polarity to that of the toner is applied during the period during which the recording material does not pass through the fixing nip (such as the period between a recording material and the next recording material (so-called inter-paper period), or forward rotation or backward rotation period).

SUMMARY OF THE INVENTION

However, it has been found that the conventional image forming apparatus disclosed in Japanese Patent Application Publication No. 2016-191824 has the following problems.

1) With the conventional image forming apparatus disclosed in Japanese Patent Application Publication No. 2016-191824, the fixing bias polarity is switched at the time other than the time during which the recording material passes through the fixing nip. More and more recent image forming apparatuses increase the number of prints per unit time by minimizing the inter-paper period, and an image forming apparatus with an inter-paper period distance of about 10 mm has also been provided. Further, in order to speed up the FPOT (First Print Output Time), more and more image forming apparatuses extend the life of the fixing apparatus by minimizing the forward rotation time or the backward rotation time, and shortening the rotation time of the fixing apparatus. Thus, with the recent image forming apparatuses, the time other than time during which a recording material passes through the fixing nip tends to be shortened. For this reason, the time during which a fixing bias with the opposite polarity can be applied in order to prevent the deposition of dust such as a filler or a paper powder and to perform cleaning is shortened, so that undesirably, the prevention of the deposition of dust becomes insufficient, or the fixing member can be cleaned only partially along the circumferential direction. Further, with an image forming apparatus having an inter-paper period distance as small as about 10 mm, undesirably, switching of the polarity of the fixing bias within the inter-paper period time is difficult from the viewpoint of the time required for switching between the positive and negative polarities of the fixing bias.

2) With the image forming apparatus disclosed in Japanese Patent Application Publication No. 2016-191824, it is fixed such that when a recording material passes through the fixing nip, a fixing bias with the same polarity as that of the toner is applied; and during the inter-paper period during which a recording material does not pass through the fixing nip, or other periods, a fixing bias with the opposite polarity to that of the toner is applied. For this reason, when a paper sheet using a filler to be charged to the opposite polarity to that of the toner is fed, dust such as the filler charged to the opposite polarity to that of the toner or a paper powder including the filler is attracted to the fixing member under the influence of the fixing bias applied during feeding of the paper sheet through the fixing nip, undesirably resulting in deposition or stain. Such a problem occurs when a paper sheet using calcium carbonate to be positively charged as a filler is fed for a negative toner; on the contrary, when a paper sheet using talk or kaolin clay to be negatively charged, or the like as a filler is fed for a positive toner. For example, when a paper sheet including calcium carbonate to be positively charged as a filler is fed with respect to a negative toner, a fixing bias of a negative bias is applied to the fixing film during the period in which the paper sheet passes through the fixing nip portion. As a result, the fixing film attracts positively charged filler and paper powder.

3) Conversely, when a fixing bias with such a polarity as not to attract a filler, a paper powder, or the like charged to the opposite polarity to that of the toner is applied during passage of the paper sheet through the fixing nip portion, this time, the toner image is attracted to the fixing member, undesirably resulting in an offset image defect. Such a problem is caused, for example, when the fixing film is applied with a positive bias so as to prevent the deposition of a positively charged filler, paper powder, or the like onto the negative toner.

4) With the image forming apparatus disclosed in Japanese Patent Application Publication No. 2016-191824, when a paper sheet using a filler to be charged to the same polarity as that of the toner is fed, the filler or paper powder is undesirably attracted to and deposited onto the fixing member by the fixing bias applied during the period in which the paper sheet does not pass through the fixing nip portion. For example, when a paper sheet using talk or the like to be charged negatively as a filler is fed with respect to a negative toner, such a problem is caused. Namely, when a paper sheet using talk or the like as a filler is fed with respect to a negative toner, the talk or a paper powder of the filler is negatively charged. For this reason, the filler or the paper powder is attracted to and deposited onto the fixing member by a positive fixing bias to be applied during the period in which a paper sheet does not pass through the fixing nip portion.

The present invention was completed in view of the foregoing problem. It is an object of the present invention to provide an image forming apparatus capable of reducing the stain due to the deposition and accumulation of dust such as a paper filler of a recording material or a paper powder, preventing an image defect due to the stain, and extending the life of the fixing apparatus.

In order to solve the foregoing problems, an image forming apparatus of the present invention includes:

an image forming portion for forming an unfixed developer image on a recording material using a developer;

a fixing portion having a fixing member, and a pressure member for coming in pressure contact with the fixing member, and forming a fixing nip portion, the fixing portion passing the recording material through the fixing nip portion, and fixing the developer image on the recording material; and a bias applying unit for applying a bias to at least one of the fixing member and the pressure member;

wherein the fixing member has a surface layer having conductivity, wherein the developer is a toner having a toner particle including a binder resin, a reactant of a polyhydric acid and a compound containing a group 4 element is present on a surface of the toner particle, and Tv/Fv>100 is satisfied where Tv represents a volume resistivity upon being unfixed, and Fv represents a volume resistivity after fixing, and wherein the bias applying unit can selectively apply a bias of a positive polarity and a bias of a negative polarity, and applies a bias of the same polarity as the charged polarity of a filler included in the recording material when the recording material passes through the fixing nip portion, and when the recording material does not pass through the fixing nip portion, respectively.

In accordance with the present invention, the polarity of the fixing bias to be applied so as to generate such an electric field to hold a charged filler/paper powder onto a recording material is switched according to the charged polarity of the filler/paper powder of the recording material to be fed. For this reason, it is possible to prevent the deposition of the charged filler/paper powder onto the fixing member. Further, a developer whose volume resistivity ratio of the developer before and after fixing satisfies Tv/Fv>100 is used as a developer. As a result, upon fixing, the volume resistivity of the developer is reduced, so that the electric charges of the developer decay. This can prevent the deposition onto the fixing member even when a fixing bias with the opposite polarity to that of the developer is applied during passage of the recording material through the fixing nip.

Namely, even when a recording material using a filler having either positively or negatively charged polarity is fed, the fixing bias to be applied is properly controlled. As a result, it is possible to prevent the deposition of the developer onto the fixing member. Therefore, it is possible to reduce the deposition of the charged filler/paper powder onto the fixing member during paper feeding and during the period other than during paper feeding without causing an offset image defect than with a conventional image forming apparatus. Further, the deposition of the filler/paper powder onto the fixing member is reduced. As a result, it is possible to reduce the accumulation of the filler/paper powder onto the fixing member, and the deposition of stain of a mixture of the filler/paper powder and the toner onto the fixing member, which can extend the life of the fixing apparatus.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

The wording "at least XX and not more than YY" or "XX to YY" means the numerical value range including the lower limit and the upper limit of the endpoint unless otherwise specified. Below, an image forming apparatus will be described by reference to the accompanying drawings. Incidentally, the following examples should not be construed as limiting the scope of the invention in accordance with the appended claims. Further, all the combinations of the features described in the following examples are not necessarily essential for the solving means of the invention.

Embodiments

Overall Structure of Image Forming Apparatus

Figure 1:
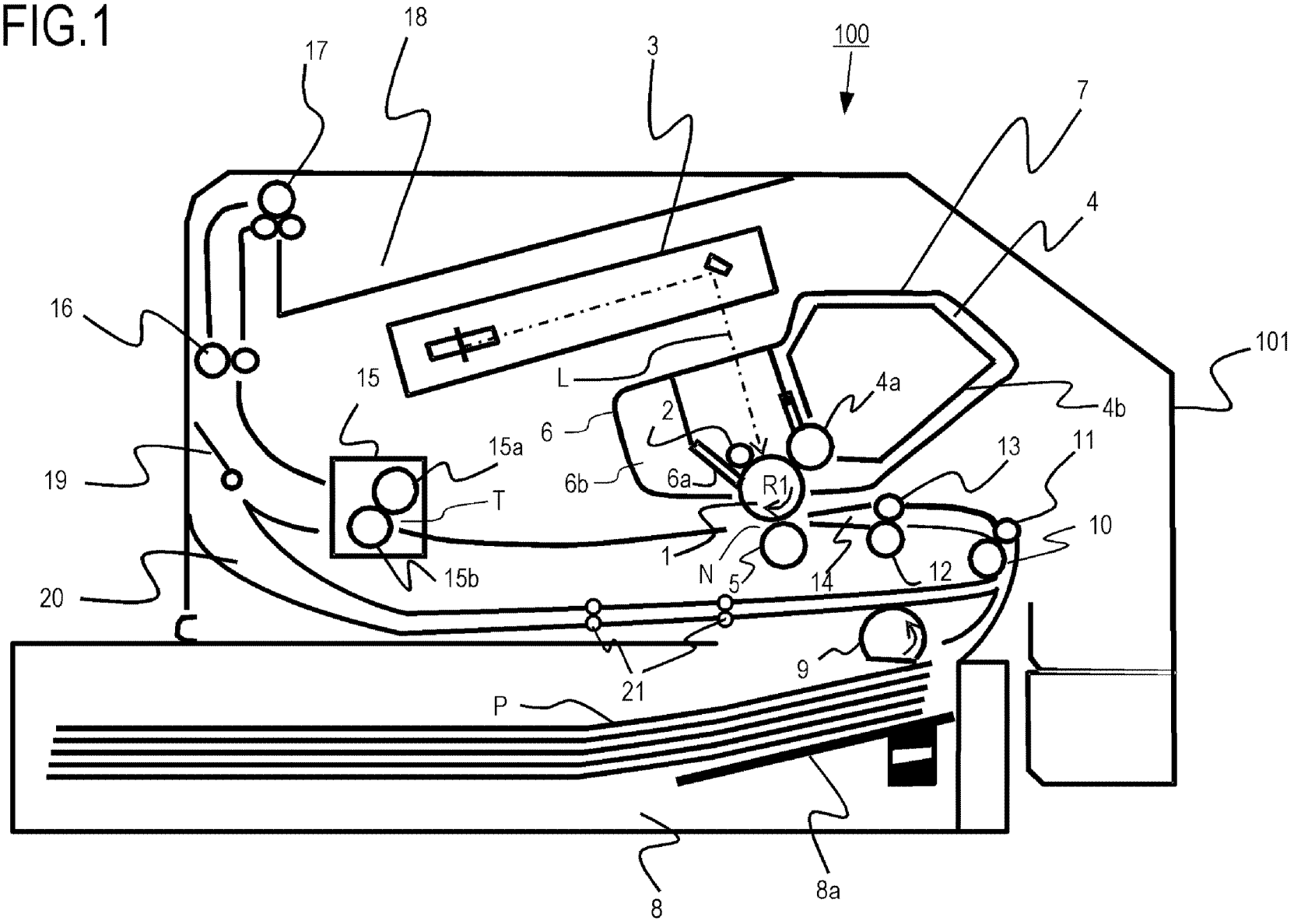
FIG. 1 is a schematic view of an image forming apparatus of the present embodiment.

FIG. 1 is a schematic cross sectional view showing a schematic configuration an image forming apparatus 100 as one example of an image forming apparatus to which the present invention is applied. Herein, as one example of the image forming apparatus, a description will be given to the example in which the present invention is applied to a monochrome printer. The image forming apparatus 100 forms an image corresponding to the image information inputted by an external device (not shown) such as a host computer on a recording material P.

The image forming apparatus 100 has a photosensitive drum 1 of a drum type (cylindrical shaped) electrophotographic photosensitive member as an image bearing member. When a print directive is inputted from an external device, the photosensitive drum 1 is rotationally driven at a prescribed speed (process speed) in the direction of an arrow R1 in the drawing. In the present embodiment, as the photosensitive drum 1, the one configured by applying an organic photoconductor layer (OPC photosensitive member) on the outer circumferential surface of an aluminum cylinder with a diameter of 30 mm is used. Further, the photosensitive drum 1 is rotatably supported at the opposite ends in the longitudinal direction (rotational axis direction) by a support member. A driving force from a driving motor (not shown) as a driving unit is transferred to one end, thereby rotationally driving the photosensitive drum 1. In the present embodiment, the charged polarity or the photosensitive drum 1 is a negative polarity.

The outer circumferential surface (surface) of the rotating photosensitive drum 1 is uniformly charged to a prescribed potential of a prescribed polarity by a charging roller 2 of a roller-shaped charging member as a charging unit. The charging roller 2 includes a conductive roller, is arranged in contact with the surface of the photosensitive drum 1, and is forced (pressed) toward the photosensitive drum 1 under a prescribed pressure. The charging roller 2 rotates following the rotation of the photosensitive drum 1. Then, the charging roller 2 is applied with a charging voltage (charging bias) of a prescribed negative polarity from a charging power supply (high voltage power supply) not shown, so that the photosensitive drum 1 is charged to a prescribed potential Vd.

Image information is written onto the surface of the charged photosensitive drum 1 by a exposure device (laser scanner) 3 of an exposure unit including a scanner unit for scanning a light emitted from a laser by a polygon mirror. The exposure device 3 outputs a laser light L modulated according to the time series electric digital pixel signal of the image information inputted from an external device to the image forming apparatus 100. Further, the exposure device 3 selectively scans and exposes the surface of the charged photosensitive drum 1 by the laser light L. As a result, the absolute value of the exposed portion (image portion) of the photosensitive drum 1 is reduced, resulting in a bright area potential Vl. Accordingly, an electrostatic latent image corresponding to the image information is formed on the photosensitive drum 1. The exposure device 3 as an exposure unit is one example of an image forming unit for forming an electrostatic image on the photosensitive drum 1 charged by a charging unit. The exposure device 3 is not limited to a laser scanner device. For example, a LED array in which a plurality of LEDs are arrayed along the longitudinal direction of the photosensitive drum 1 may be adopted.

The electrostatic latent image formed on the photosensitive drum 1 is developed (visualized) as a toner image using a toner as a developer by a developing apparatus 4 as a developing unit. The developing apparatus 4 has a development roller 4*a* as a developer bearing member, and a developer container 4*b* for accommodating a toner to be supplied to the development roller 4*a*. In the present embodiment, as the development roller 4*a*, the one configured by coating a polymer elastic body such as EPDM (ethylene-propylene-diene terpolymer) on the surface of a roller made of a metal and with a diameter of 20 mm is used. The development roller 4*a* is applied with a developing voltage (developing bias) of a prescribed direct current from a developing power supply (high voltage power supply) not shown. The toner fed from the developer container 4*b* to the development roller 4*a* is selectively deposited on the surface of the photosensitive drum 1 according to the pattern of an electrostatic latent image by the electric field formed between the development roller 4*a* and the photosensitive drum 1 at the developing position at which the development roller 4*a* and the photosensitive drum 1 are opposed to each other. In the present embodiment, the toner charged to the same polarity as the charged polarity of the photosensitive drum 1 is deposited on the exposed portion on the photosensitive drum 1 uniformly subjected to a charging treatment, followed by exposure, and reduced in absolute value of the potential, so that a toner image is formed (reversal development).

A transfer roller 5 of a roller-shaped transfer member as a transfer unit is arranged opposed to the photosensitive drum 1. The transfer roller 5 is arranged in contact with the surface of the photosensitive drum 1, and is forced (pressed) toward the photosensitive drum 1 under a prescribed pressure. As a result, a transfer portion N of a nip portion (transfer nip) is formed between the surface of the photosensitive drum 1 and the outer circumferential surface (surface) of the transfer roller 5. In the present embodiment, the transfer roller 5 is a conductive roller including a conductive elastic body (NBR hydrin rubber) with an electric resistance of about $10^6$ to $10^9\Omega$ provided around a shaft made of a metal such as stainless steel, and with an outer diameter of 6 mm so that the outer diameter may become 17 mm.

Figure 2:
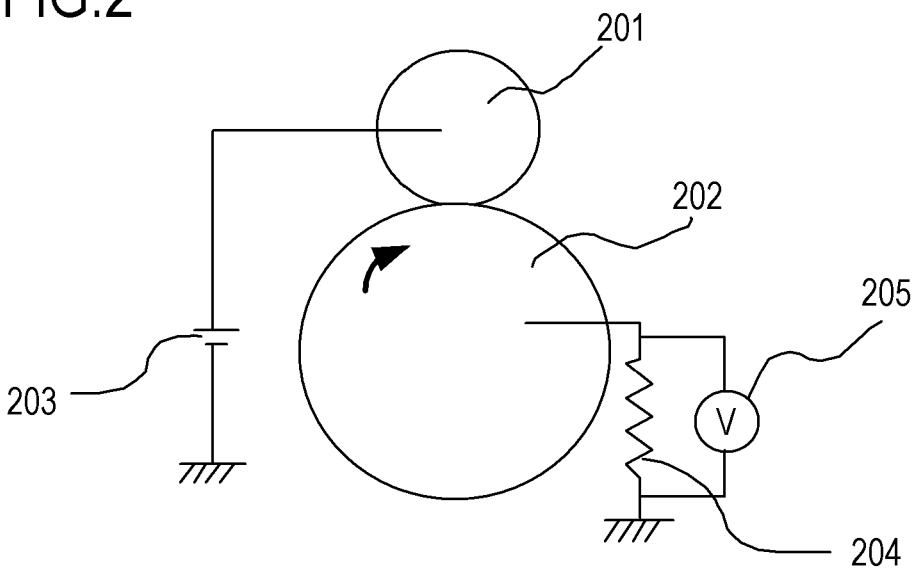
FIG. 2 is a view for illustrating a resistance measurement method of a roller member.

Incidentally, the resistance value R is measured by the method as shown in FIG. 2 under environment of 23° C. and 50% RH. Namely, a roller 201 to be measured is brought into contact with an aluminum cylinder 202 with a diameter of 30 under a total pressure of 9.8 N (1 kgf), and is rotated at 30 rpm. Thus, the current when a voltage of 1000 V is applied from a power supply 203 is measured. The current is determined by measuring the inter-terminal voltage Vr of a resistance 204 of 100Ω by means of a voltmeter 205. Then, the roller resistance R can be determined by the following equation (1).

$$\text{Roller resistance } R = \text{Applied voltage} \times 100/Vr \quad (1)$$

The transfer roller 5 is applied with a prescribed transfer voltage (transfer bias) of a positive polarity which is the opposite polarity to the charged polarity (normal charged polarity) of a toner upon development from a transfer power supply (high voltage power supply) not shown. As a result, the toner image on the photosensitive drum 1 fed to the transfer portion N is transferred onto a recording material P.

On the other hand, the recording materials P loaded on a sheet loading stand 8*a* of a feeding cassette 8 are picked up one by one by a driven feed roller 9 driven at a prescribed control timing, and are fed to a resist portion by a transport roller 10 and a transport roller unit 11. At the resist portion, the tip of the recording material P is once received at a nip portion between a resist roller 12 and a resist roller unit 13, so that oblique correction of the recording material P is performed. Thus, at a prescribed transport timing, the recording material P is fed to the transfer portion N. Namely, at the resist portion, the transport timing of the recording material P is controlled so that when the tip segment of the toner image on the surface of the photosensitive drum 1 reaches the transfer portion N, the tip segment of the recording material P also reaches the transfer portion N. The recording material P which has passed through the resist portion is transported along a transfer entrance guide 14, and is guided to the transfer portion N.

While the recording material P fed to the transfer portion N is interposed by the photosensitive drum 1 and the transfer roller 5, and is transported, a toner image is transferred thereon. The transfer roller 5 varies in resistance according to the atmospheric temperature and humidity or the durability situation. Further, the recording material P also varies in resistance according to the kind thereof, or according to the atmospheric temperature and humidity, or also varies in resistance according to how the first-page toner is placed for forming a second-page image. Thus, control referred to as ATVC (Active Transfer Voltage Control) is performed as follows: the voltage value to be applied to the transfer roller 5 is controlled so that a prescribed transfer current may pass between the transfer roller 5 and the photosensitive drum 1. By the transfer voltage determined by the ATVC control, the toner image on the photosensitive drum 1 is transferred onto the recording material P. Up to this point, for the image forming apparatus 100, the configuration involved in the formation of a toner image unfixed on the recording material P corresponds to the image forming portion (image forming unit) of the present invention.

Thereafter, the recording material P is separated from the surface of the photosensitive drum 1, and is transported to a fixing apparatus 15 as the fixing portion (fixing unit) of the image forming apparatus 100. From the surface of the photosensitive drum 1 from which the recording material P has been separated, the untransferred toner is removed by a cleaner 6 as a cleaning unit, and is repeatedly subjected to imaging. The cleaner 6 has a cleaning blade 6*a* as a cleaning member, and a collecting container 6*b* for accommodating the untransferred toner cleared away from the surface of the rotating photosensitive drum 1 by the cleaning blade 6*a*.

The fixing apparatus 15 has a fixing film as a fixing rotating member (fixing member), a fixing film unit 15*a* including a heater or the like as a heat source, and a pressure roller 15*b* as a pressure rotating member (pressure member) to be brought into pressure contact with the fixing film unit 15*a*. The fixing film unit 15*a* and the pressure roller 15*b* come in contact with each other, thereby forming a fixing portion (heating portion) T of a nip portion (fixing nip). Namely, the fixing portion T is formed of the heater and the pressure roller 15*b* via the fixing film. The fixing apparatus 15 applies a heat and a pressure to the recording material P bearing an unfixed toner image at the fixing portion T, thereby fixing (sticking) an unfixed toner image onto the recording material P. The fixing apparatus 15 is one example of a heating unit for heating the recording material P separated from the photosensitive drum 1 at the heating portion T, particularly the heating unit having a rotating member rotating while coming in contact with the recording material P at the heating portion T, and heating the recording material P. The recording material P exhausted from the fixing apparatus 15 is transported by an intermediate discharging roller 16.

Herein, the image forming apparatus 100 is capable of implementing single side image formation (single side print) for fixing a toner image on the single side of the recording material P, and outputting the resulting image, and double side image formation (double side print) for fixing a toner image on double sides of a first side (front surface) and a second side (back surface) of the recording material P, and outputting the resulting image. When single side image formation is performed, the recording material P is transported through the intermediate discharging roller 16 to a discharge roller 17, and is discharged onto a discharge tray 18. On the other hand, when double side image formation is performed, the recording material P is once transported midway by the intermediate discharging roller 16, and then is switched back due to the inverse rotation of the intermediate discharging roller 16. Thus, an inverting flapper 19 is switched, so that the recording material P is fed to a double side transport path 20. The recording material P fed to the double side transport path 20 is moved by a double side transport roller 21, and is fed to the resist portion by the transport roller 10 and the transport roller unit 11 again. Subsequently, by the same step as the first side (front surface side) image formation, the second side (back side) image formation is performed. After the second side image formation, the recording material P is transported through the intermediate discharging roller 16 to the discharge roller 17, and is discharged onto the discharge tray 18.

Incidentally, in the present embodiment, the photosensitive drum 1, and the charging roller 2, the developing apparatus 4, and the cleaner 6 as process unit acting on the photosensitive drum 1 are integrated, thereby forming a process cartridge 7. The process cartridge 7 is mounted detachably with respect to the apparatus main body 101 forming the housing of the image forming apparatus 100.

In the present embodiment, the integrated process cartridge is used. However, a cartridge of a so-called toner replenishing system for replenishing a new toner from a toner bottle or a toner pack into the developer container may be used.

Description of Toner

The present inventors conducted a close study in order to solve the problem of a conventional image forming apparatus. As a result, the present inventors found the following: using a toner having a toner particle containing a binder resin, the surface of the toner particle having a reactant of a polyhydric acid and a compound containing a group 4 element, and $Fv<Tv$ being satisfied in which Tv represents the volume resistivity of a toner image being unfixed, and Fv represents the volume resistivity of the toner image after fixing which has been heated and pressurized, the polarity of the fixing bias to be applied to the fixing apparatus is controlled; as a result, it is possible to reduce the deposition or stain of dust such as filler of the recording material or paper powder onto the fixing member.

A polyhydric acid tends to receive an electron pair, and to be negatively charged. For this reason, the reactant of a polyhydric acid and a compound containing a group 4 element also tends to be negatively charged, and is excellent in charging performance. Further, a group 4 element (a metal of a titanium group element) is most stable with the oxidation number of +4. For this reason, a crosslinking structure with a polyhydric acid is formed, and the crosslinking structure promotes transfer of electrons. Therefore, for a toner having a reactant of a polyhydric acid and a compound containing a group 4 element on the toner particle surface, the electric charges given to the toner surface tend to be transmitted through the crosslinking structure and to propagate to the entire surface. When the toner is heated and pressurized by fixing, the reactant of a polyhydric acid and a compound containing a group 4 element on the toner particle surface is mixed with the molten toner particle. This allows the characteristic of facilitating transfer of electric charges into the toner particle inside to be exhibited. As a result, the volume resistivity after fixing is reduced as compared with the unfixed state.

On the other hand, for the toner not having the reactant of a polyhydric acid and a compound containing a group 4 element on the surface, and, for example, containing titanium oxide as a resistance adjuster, as compared with the reactant of a polyhydric acid and a compound containing a group 4 element, the electric charges given by contact is less likely to transfer on the surface, and the electric charges tend to be localized to (the contact portion of) the surface.

Further, also due to the contact between the toner particles, as compared with the reactant of a polyhydric acid and a compound containing a group 4 element, the electric charges are less likely to transfer. Furthermore, even when the toner is heated and pressurized by fixing, as compared with the reactant of a polyhydric acid and a compound containing a group 4 element, the characteristic of transferring the electric charges into the toner particle inside is not exhibited. As a result, it is considered as follows: there is no significant difference in volume resistivity between after fixing and in an unfixed state, and the effects as those of the toner of the present invention are not produced.

Any polyhydric acid is acceptable so long as the polyhydric acid is a divalent or higher valent acid. Specific examples thereof may include the following.

Inorganic acids such as phosphoric acid, carbonic acid, and sulfuric acid; and organic acids such as dicarboxylic acid and tricarboxylic acid.

Specific examples of the organic acid may include the following.

Dicarboxylic acids such as oxalic acid, malonic acid, succinic acid, glutaric acid, adipic acid, fumaric acid, maleic acid, pimelic acid, suberic acid, azelaic acid, sebacic acid, phthalic acid, isophthalic acid, and terephthalic acid.

Tricarboxylic acids such as citric acid, aconitic acid, and trimellitic anhydride.

Out of these, preferably, polyhydric acids include at least one selected from the group consisting of carbonic acid, sulfuric acid, and phosphoric acid, because the polyhydric acids strongly react with a group 4 element, and are less likely to be hygroscopic. More preferably, polyhydric acids include phosphoric acid. For the polyhydric acid, polyhydric acid may be used as it is. Alternatively, polyhydric acid may be used as an alkali metal salt of polyhydric acid and sodium, potassium, lithium, or the like; an alkaline-earth metal salt with magnesium, calcium, strontium, barium, or the like; or an ammonium salt of polyhydric acid.

The compound containing a group 4 element has no particular restriction so long as it is a compound containing a group 4 element, and any compound is acceptable. As the group 4 elements, mention may be made of titanium, zirconium, hafnium, and the like. Out of these, the group 4 elements preferably include at least one of titanium and zirconium.

Specific examples of the compound including titanium may include the following.

Titanium alkoxide such as tetraisopropyl titanate, tetrabutyl titanate, or tetraoctyl titanate.

Titanium chelates such as titanium diisopropoxy bis(acetylacetonate), titanium tetraacetylacetonate, titanium diisopropoxy bis(ethyl acetoacetate), titanium di-2-ethyl hexoxybis2-ethyl-3-hydroxy hexoxide, titanium diisopropoxy bisethyl acetoacetate, titanium lactate, titanium lactate ammonium salt, titanium diisopropoxy bistriethanol aminate, titanium isostearate, titanium amino ethyl aminoethanolate, and titanium triethanolaminate.

Out of these, titanium chelate tends to react with a polyhydric acid, and hence is preferable. Further, titanium lactate, and titanium lactate ammonium salt are more preferable.

Specific examples of the compound including zirconium may include the following.

Zirconium alkoxides such as zirconium tetrapropoxide, and zirconium tetrabutoxide.

Zirconium chelates such as zirconium tetraacetylacetonate, zirconium tributoxy monoacetylacetonate, zirconium dibutoxy bis(ethyl acetoacetate), zirconium lactate, and zirconium lactate ammonium salt.

Out of these, zirconium chelate tends to react with a polyhydric acid, and hence is preferable. Further, zirconium lactate, and a zirconium lactate ammonium salt are more preferable.

Specific examples of the compound including hafnium may include the following.

Hafnium chelates such as hafnium lactate and a hafnium lactate ammonium salt.

Examples of the surface of the toner particle having the reactant of a polyhydric acid and a compound containing a group 4 element may include the state in which the reactant of a polyhydric acid and a compound containing a group 4 element is present on the surface of the toner particle. As the method for allowing the reactant of a polyhydric acid and a compound containing a group 4 element to be present on the surface of the toner particle, various conventionally known methods can be used. For example, there is the following method.

A method in which in a dispersion of a toner base particle, a polyhydric acid and a compound containing a group 4 element are allowed to react with each other, and the resulting reactant is deposited on the surface of the toner base particle, thereby obtaining a toner particle. For example, mention may be made of a method in which a polyhydric acid and a compound containing a group 4 element are added and mixed to a dispersion of a toner base particle, sot that the polyhydric acid and the compound containing a group 4 element are allowed to react with each other, resulting in a reactant, and simultaneously, the dispersion is stirred, thereby depositing the reactant on the surface of the toner base particle, resulting in a toner particle.

Further, for example, mention may be made of the following method: a polyhydric acid and a compound containing a group 4 element are allowed to react with each other, thereby manufacturing a fine particle including the reactant, which is mixed with a toner base particle; as a result, the fine particle including the reactant is deposited on the surface of the toner base particle, resulting in a toner particle. Specifically, using a high speed stirrer for imparting a shear force such as a FM mixer, a Mechano Hybrid (manufactured by NIPPON COKE & ENGINEERING CO., LTD.), a supermixer, or a NOBILTA (manufactured by HOSOKAWA MICRON CORPORATION), the toner base particle and the fine particle of the reactant may be mixed. Out of these, the following method is preferable: a polyhydric acid and a compound containing a group 4 are added and mixed to the dispersion of the toner base particle, so that the polyhydric acid and the compound containing a group 4 element are allowed to react with each other, resulting in a reactant, and simultaneously, the dispersion is stirred; as a result, the reactant is deposited on the surface of the toner base particle, thereby obtaining a toner particle.

The foregoing method can provide a toner particle with the fine-particle-shaped reactant of a polyhydric acid and a compound containing a group 4 element uniformed dispersed on the toner particle, and, with the toner base particle and the reactant strongly bonded to each other.

The reactant of a polyhydric acid and a compound containing a group 4 element can be obtained by allowing a polyhydric acid and a compound containing a group 4 element to react with each other in a solvent. Any solvent is acceptable as the solvent. Specific examples of the solvent may include the following.

Hexane, benzene, toluene, diethyl ether, chloroform, ethyl acetate, tetrahydrofuran, acetone, acetonitrile, N,N-dimethylformamide, 1-butanol, 1-propanol, 2-propanol, methanol, ethanol, and water.

The reactant of a polyhydric acid and a compound containing a group 4 element has no particular restriction. A salt of a polyhydric acid and a group 4 element (which will be hereinafter also referred to as a polyhydric acid metal salt) is preferable. From the viewpoint of suppression of image deterioration for a large number of prints, at least one selected from the group consisting of titanium sulfate, titanium carbonate, titanium phosphate, zirconium sulfate, zirconium carbonate, and zirconium phosphate is preferably included. More preferably, at least one of titanium phosphate and zirconium phosphate is included.

The number-average particle diameter of the fine particles including the reactant of a polyhydric acid and a compound containing a group 4 element is preferably at least 1 nm and not more than 400 nm, more preferably at least 1 nm and not more than 200 nm, and further preferably at least 1 nm and not more than 60 nm. By setting the number-average particle diameter of the fine particles within the foregoing range, it is possible to suppress the contamination of the member due to the desorption of the fine particle. As the method for adjusting the number-average particle diameter of the fine particles within the foregoing range, mention may be made of the method based on the addition amount of the polyhydric acid and the compound containing a group 4 element which are the raw material for the fine particle, the pH upon the reaction therebetween, the temperature during the reaction, and the like.

The content of the reactant of a polyhydric acid and a compound containing a group 4 element in the toner particle is preferably at least 0.01 mass % and not more than 5.00 mass %, and more preferably at least 0.01 mass % and not more than 3.00 mass %.

For the toner of the present invention, preferably, M1 is at least 1.0 (at %) and not more than 10.0 (at %), where a metal element M represents the metal element included in the polyhydric acid metal salt, and M1 (at %) represents the ratio of the metal element M in the constituent element ratio of the toner surface determined from the spectrum obtained by the X-ray photoelectron spectroscopy of the toner.

Further, 1 g of the toner is dispersed in a mixed aqueous solution including 31 g of a 61.5% cane sugar aqueous solution, and 6 g of 10% neutral detergent aqueous solution for precision measuring device cleaning including a nonionic surfactant and an anionic surfactant, and a treatment (a) of performing shaking 300 times for one minute using a shaker is performed, resulting in a toner. The resulting toner is referred to as a toner (a). The ratio of the metal element M in the toner surface constituent element ratio determined from the spectrum obtained by the X-ray photoelectron spectroscopy of the toner (a) is referred to as M2 (at %). Thus, the M1 and the M2 are both at least 1.0 and not more than 10.0, and the M1 and the M2 preferably satisfy the following relational expression (ME-1):

$$0.90 \leq M2/M1 \quad \text{(ME-1)}$$

With the treatment (a), it is possible to remove the polyhydric acid metal salt weakly deposited on the toner surface. Specifically, the polyhydric acid metal salt deposited on the toner base particle with a dry method tends to be removed by the treatment (a). Thus, it is possible to evaluate the polyhydric acid metal salt present on the toner surface by the treatment (a). A smaller change in each parameter by the treatment (a) indicates a stronger adherence of the polyhydric acid metal salt to the toner base particle.

The M1 and M2 represent the covering states of the toner surface by the polyhydric acid metal salt before and after each treatment. Then, the covering state of the toner surface by the polyhydric acid metal salt contributes to the charging performance and the transferability of electric charges. The M1 and M2 are preferably at least 1.0 (at %) and not more than 10.0 (at %). When the M1 and M2 fall within the range, the negatively charging performance of the toner and the transferability of electric charges become further favorable. The M1 and M2 is more preferably at least 1.0 (at %) and not more than 7.0 (at %), and further preferably at least 1.5 (at %) and not more than 5.0 (at %).

The expression (ME-1) means the ratio of the polyhydric acid metal salt not peeled from, and remaining on the toner surface with the treatment (a). When the expression (ME-1) is 0.90 or more, the polyhydric acid metal salt strongly adheres to the toner surface. For this reason, transfer of the polyhydric acid metal salt from the toner to the member is suppressed. Accordingly, it is possible to obtain a toner stable and excellent in durability even in use over a long period.

When a polyhydric acid and a compound containing a group 4 element are allowed to react with each other in a dispersion of a toner base particle, and the resulting reactant is deposited on the toner base particle surface, thereby obtaining a toner particle, the organosilicon compound expressed by the following expression (2) is preferably used in combination. Use of the organosilicon compound in combination allows the resulting reactant to more strongly adhere to the toner particle, and makes the reactant of a polyhydric acid and a compound containing a group 4 element hydrophobic, resulting in a further improvement of the environmental stability.

Specifically, first, a dispersion of a toner base particle is prepared. The toner base particle is preferably a toner base particle including a protruded portion formed by a method described later. Then, an organosilicon compound (preferably expressed by the following expression (2)) is hydrolyzed. The organosilicon compound may be hydrolyzed previously, or may be hydrolyzed in the dispersion of the toner base particle. Then, when a polyhydric acid and a compound containing a group 4 element are allowed to react with each other in a dispersion of a toner base particle, and the resulting reactant is deposited on the toner base particle surface, the resulting hydrolysate of the organosilicon compound is condensed, resulting in a toner particle. The resulting condensate transfers to the toner particle surface. The condensate has a viscosity. For this reason, the reactant of a polyhydric acid and a compound containing a group 4 element can be brought into close contact with the surface of the toner particle, and the reactant can be allowed to more strongly adhere to the toner particle. Further, the condensate also transfers to the surface of the reactant, which can make the reactant hydrophobic, and can further improve the environmental stability.

By using the compound expressed by the expression (2), the substituent represented by $R_b$ has affinity with a toner base particle, and hence strongly adheres to the toner base particle, the silicon polymer portion in the resulting condensate has affinity with the reactant of a polyhydric acid and a compound containing a group 4 element, and strongly adheres to the reactant. As the aspect in which the reactant of a polyhydric acid and a compound containing a group 4 element is present on the surface of the toner particle, the reactant of a polyhydric acid and a compound containing a group 4 element is preferably deposited on the toner particle surface via an organosilicon polymer. Further, the reactant of a polyhydric acid and a compound containing a group 4 element is preferably not the one adhering thereto by a mechanical impact force.

$$R_{a(n)}—Si—R_{b(4-n)} \quad (2)$$

In the expression (2), $R_a$ represents a halogen atom, a hydroxy group, or an alkoxy group having (preferably 1 to 4 carbon atoms, and more preferably 1 to 3 carbon atoms), $R_b$ represents an alkyl group having (preferably 1 to 8 carbon atoms, and more preferably 1 to 6 carbon atoms), an alkenyl group having (preferably 1 to 6 carbon atoms, and more preferably 1 to 4 carbon atoms), an aryl group having (preferably 6 to 14 carbon atoms, and more preferably 6 to 10 carbon atoms), an acyl group or a methacryloxyalkyl group having (preferably 1 to 6 carbon atoms, and more preferably 1 to 4 carbon atoms). n represents an integer of 2 to 4. However, when a plurality of $R_a$s and $R_b$s are present, the substituents of the plurality of $R_a$s, and the plurality of $R_b$s may be the same or different, respectively. Hereinafter, $R_a$ in the expression (2) is referred to as a functional group, and $R_b$ is referred to as a substituent. The organosilicon compound expressed by the expression (2) has no particular restriction, and a known organosilicon compound can be used. Specifically, mention may be made of a silane compound having two functional groups, a trifunctional silane compound having three functional groups, and a quadrafunctional silane compound having four functional groups, below.

As the difunctional silane compounds, mention may be made of dimethyl dimethoxy silane, dimethyl diethoxy silane, or the like.

As the trifunctional silane compounds, mention may be made of the following.

Trifunctional silane compounds having an alkyl group as a substituent such as methyl trimethoxy silane, methyl triethoxy silane, methyl diethoxy methoxy silane, methyl ethoxy dimethoxy silane, ethyl trimethoxy silane, ethyl triethoxy silane, propyl trimethoxy silane, propyl triethoxy silane, butyl trimethoxy silane, butyl triethoxy silane, hexyl trimethoxy silane, hexyl triethoxy silane, octyl trimethoxy silane, octyl triethoxy silane, decyl trimethoxy silane, and decyl triethoxy silane;

Trifunctional silane compounds having an alkenyl group as a substituent such as vinyl trimethoxy silane, vinyl triethoxy silane, allyl trimethoxy silane, and allyl triethoxy silane;

Trifunctional silane compounds having an aryl group as a substituent such as phenyl trimethoxy silane, and phenyl triethoxy silane;

Trifunctional silane compounds having a methacryloxyalkyl group as a substituent such as γ-methacryloxypropyl trimethoxy silane, γ-methacryloxypropyl triethoxy silane, γ-methacryloxypropyl diethoxy methoxy silane, and γ-methacryloxypropyl ethoxy dimethoxy silane; and the like.

As the quadrafunctional silane compounds, mention may be made of tetramethoxy silane, tetraethoxy silane, tetrapropoxy silane, tetrabutoxy silane, and the like.

The content of the condensate of at least one organosilicon compound selected from the group consisting of the organosilicon compounds expressed by the expression (2) in the toner particle is preferably at least 0.1 mass % and not more than 20.0 mass %, and more preferably at least 0.5 mass % and not more than 15.0 mass %.

The toner particle preferably has a toner base particle including a binder resin, and the protruded portion of the toner base particle surface. Then, the protruded portion preferably includes an organosilicon polymer. The formation method of the protruded portion including an organosilicon polymer has not particular restriction, and a known method can be used. For example, when a toner particle is formed in an aqueous medium, while performing a polymerization step or the like in the aqueous medium, the hydrolyzed solution of an organosilicon compound is added as described above, so that the protruded portion can be formed. Alternatively, mention may be made of the method in which an organosilicon compound is condensed in an aqueous medium including a toner base particle dispersed therein, thereby forming a protruded portion on the toner base particle. Still alternatively, mention may be made of the method in which the protruded portion including an organosilicon polymer is deposited on the toner base particle by a mechanical external force with a dry method or a wet method. Out of these, the method in which an organosilicon compound is condensed in an aqueous medium including the toner base particle dispersed therein, thereby forming a protruded portion on the toner base particle is preferable because the method can cause the toner base particle and the protruded portion to strongly adhere to each other.

The foregoing method will be described. When a protruded portion is formed on the toner base particle surface with the foregoing method, the method preferably includes a step (step 1) of obtaining a toner base particle dispersion including a toner base particle dispersed in an aqueous medium, and a step (step 2) of mixing an organosilicon compound (and/or a hydrolysate thereof) with a toner base particle dispersion, and effecting the condensation reaction of the organosilicon compound in the toner base particle dispersion, thereby forming a protruded portion including an organosilicon polymer on the toner base particle.

As the method for obtaining a toner base particle dispersion in the step 1, mention may be made of a method in which the dispersion of a toner base particle manufactured in an aqueous medium is used as it is; a method in which a dried toner base particle is charged into an aqueous medium, and is mechanically dispersed therein; or other methods. When the dried toner base particle is dispersed in an aqueous medium, a known dispersion assistant may be used.

In the step 2, the organosilicon compound may be added as it is to the toner base particle dispersion, or may be added to the toner base particle dispersion after hydrolysis. Especially, addition after hydrolysis facilitates the control of the condensation reaction, and can reduce the amount of the organosilicon compound left in the toner base particle dispersion, and hence is preferable.

Hydrolysis is preferably performed in an aqueous medium with the pH adjusted using known acid and base. It is known that the hydrolysis of the organosilicon compound has the pH dependence. The pH for performing the hydrolysis is preferably appropriately changed according to the kind of the organosilicon compound. For example, when methyl triethoxy silane is used as the organosilicon compound, the pH of the aqueous medium is preferably at least 2.0 and not more than 6.0.

The condensation reaction in the step 2 is preferably controlled by adjusting the pH of the toner base particle dispersion. It is known that the condensation reaction of the organosilicon compound has the pH dependence. The pH for performing the condensation reaction is preferably appropriately changed according to the kind of the organosilicon compound.

For example, when methyl triethoxy silane is used as the organosilicon compound, the pH of the aqueous medium is preferably at least 6.0 and not more than 12.0. By adjusting the pH, it is possible to control the height of the protruded portion and the width of the protruded portion. For the organosilicon compound, the compound expressed by the expression (I) can be used.

After the formation of the protruded portion, the reactant of a polyhydric acid and a compound containing a group 4 element is preferably allowed to be present on the surface of the toner particle by the foregoing method. Namely, the toner particle preferably has the reactant of a polyhydric acid and a compound containing a group 4 element on the surface of the protruded portion.

The organosilicon polymer preferably has the structure expressed by the following expression (II).

$$R—SiO_{3/2} \quad (II)$$

(in the expression (II), R represents an alkyl group having (preferably 1 to 8, and more preferably 1 to 6 carbon atoms), an alkenyl group having (preferably 1 to 6, and more preferably 1 to 4 carbon atoms), an acyl group having (preferably 1 to 6, and more preferably 1 to 4 carbon atoms), or an aryl group or a methacryloxyalkyl group having (preferably 6 to 14, and more preferably 6 to 10 carbon atoms)).

The expression (II) represents that the organosilicon polymer has an organic group and a silicon polymer portion. As a result of this, in the organosilicon polymer including the structure expressed by the expression (II), the organic group has affinity with a toner base particle, and hence strongly adheres to the toner base particle, and the silicon polymer portion has affinity with the reactant of a polyhydric acid and a compound containing a group 4 element, and hence strongly adheres to the reactant.

Further, the expression (II) represents that the organosilicon polymer is crosslinked. The organosilicon polymer has a crosslinking structure, resulting in an increase in the strength of the organosilicon polymer. In addition, the number of the remaining silanol groups decreases, resulting in an increase in hydrophobicity. Accordingly, further, the durability is excellent.

In the expression (II), R is preferably an alkyl group having at least 1 and not more than 6 carbon atoms such as a methyl group, a propyl group, or a normal hexyl group, a vinyl group, a phenyl group, or a methacryloxypropyl group, and more preferably is an alkyl group or a vinyl group having at least 1 and not more than 6 carbon atoms. The organosilicon polymer having the structure is controlled in terms of the molecular mobility of the organic group, and thereby has both the hardness and the flexibility, and hence is suppressed in deterioration of the toner and exhibits excellent performances even when used over a long period.

The toner particle surface further has a fine particle. The number-average particle diameter of the fine particle is preferably at least 50 nm and not more than 500 nm, and more preferably at least 50 nm and not more than 200 nm. The inclusion of the fine particle enables the control of transfer of the reactant of a polyhydric acid and a compound containing a group 4 element present on the toner particle surface to the member due to the spacer effect. Accordingly, the reduction of the charging ability of the toner and the reduction of the charging imparting ability of the charging member are suppressed even in use over a long period.

The fine particle has no particular restriction, and a conventionally known fine particle can be used. Specifically, mention may be made of a crosslinked or non-crosslinked resin fine particle typified by polystyrene, polyester, polycarbonate, acrylic resin, melamine resin, urine resin, phenol resin, or the like, a technical product silica fine particle such as wet method silica or dry method silica, or a silica fine particle obtained by subjecting the technical product silica fine particle to a surface treatment by a treatment agent such as a silane coupling agent, a titanium coupling agent, or a silicone oil, an organosilicon polymer fine particle having an organosilicon polymer resulting from polymerization of an organosilicon compound, or the like. Out of these, the fine particle is preferably a fine particle including silicon, and more preferably is a silica fine particle.

The content of the fine particle is preferably at least 0.1 part by mass and not more than 5.0 parts by mass for every 100.0 parts by mass of toner particle.

The manufacturing method of the toner base particle has no particular restriction, and known suspension polymerization method, dissolution suspension method, emulsifying aggregation method, pulverization method, and the like can be used. When the toner base particle is manufactured in an aqueous medium, the aqueous medium including the toner base particle may be used as it is as a dispersion of a toner base particle. Alternatively, after performing cleaning, filtration, and drying, redispersion in an aqueous medium may be performed, resulting in a dispersion of a toner base particle. On the other hand, when the toner base particle is manufactured by a dry method, dispersion in an aqueous medium may be performed with a known method, resulting in a dispersion of a toner base particle. For dispersing the toner base particle in an aqueous medium, the aqueous medium preferably contains a dispersion stabilizer.

Below, a manufacturing example of a toner base particle using a suspension polymerization method will be described specifically. First, a polymerizable monomer capable of generating a binder resin, and, if required, various additives are mixed, and a polymerizable monomer composition including the materials dissolved or dispersed therein is prepared using a disperser. As various additives, mention may be made of a colorant, a wax, a charge control agent, a polymerization initiator, a chain transfer agent, and the like. As the dispersers, mention may be made of a homogenizer, a ball mill, a colloid mill, or an ultrasonic disperser.

Then, a polymerizable monomer composition is charged into an aqueous medium containing a hardly water soluble inorganic fine particle, and a droplet of the polymerizable monomer composition is prepared using a high speed disperser such as a high speed stirrer or an ultrasonic disperser (granulating step). Subsequently, the polymerizable monomer in the droplet is polymerized, resulting in a toner base particle (polymerizing step). The polymerization initiator may be mixed when a polymerizable monomer composition is prepared, or may be mixed in the polymerizable monomer composition immediately before forming a droplet in an aqueous medium. Alternatively, during granulation of a droplet or after completion of granulation, namely, immediately before starting the polymerization reaction, if required, the polymerization initiator can be added while being dissolved in a polymerizable monomer or another solvent. After polymerizing the polymerizable monomer, and obtaining a resin particle, if required, a desolvation treatment is desirably performed, thereby obtaining a dispersion of a toner base particle.

As the binder resins, the following resins or polymers can be exemplified.

A vinyl type resin; a polyester resin; a polyamide resin; a furan resin; an epoxy resin; a xylene resin; and a silicone resin.

Out of these, a vinyl type resin is preferable. Incidentally, as the vinyl type resins, mention may be made of the polymers of the following monomers or copolymers thereof. Out of these, a copolymer of a styrene type monomer and an unsaturated carboxylic acid ester is preferable.

A styrene type monomer such as styrene or α-methyl styrene; unsaturated carboxylic acid ester such as methyl acrylate, butyl acrylate, methyl methacrylate, 2-hydroxyethyl methacrylate, t-butyl methacrylate, or 2-ethylhexyl methacrylate; unsaturated carboxylic acid such as acrylic acid or methacrylic acid; unsaturated dicarboxylic acid such as maleic acid; unsaturated dicarboxylic anhydride such as maleic anhydride; nitrile type vinyl monomer such as acrylonitrile; halogen-containing vinyl monomer such as vinyl chloride; and nitro type vinyl monomer such as nitro styrene.

As the colorant, the following black pigment, yellow pigment, magenta pigment, cyan pigment, or the like is used (in the present embodiment, a monochrome printer is used; however, a description will be given to an example of a pigment of yellow, magenta, or cyan toner when the colorant is used for a color printer).

As the black pigment, mention may be made of carbon black, or the like.

As the yellow pigment, mention may be made of a monoazo compound; a disazo compound; a condensed azo compound; an isoindolinone compound; an isoindoline compound; a benzimidazolone compound; an anthraquinone compound; an azo metal complex; a methine compound; or an allyl amido compound.

Specifically, mention may be made of C.I. Pigment Yellow 74, 93, 95, 109, 111, 128, 155, 174, 180, 185, or the like.

As the magenta pigment, mention may be made of a monoazo compound; a condensed azo compound; a diketopyrrolopyrrole compound; an anthraquinone compound; a quinacridone compound; a base dye lake compound; a naphthol compound: a benzimidazolone compound; a thioindigo compound; or a perylene compound.

Specifically, mention may be made of C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, or 269, C.I. Pigment Violet 19, or the like.

As the cyan pigment, mention may be made of a copper phthalocyanine compound and a derivative thereof; an anthraquinone compound; or a base dye lake compound. Specifically, mention may be made of C.I. Pigment Blue 1, 7, 15, 15:1, 15:2, 15:3, 15:4, 60, 62, or 66.

Further, various dyes conventionally known as colorants may be used in combination with the pigment. The content of the colorant is preferably at least 1.0 part by mass and not more than 20.0 parts by mass for every 100 parts by mass of the binder resin.

The toner can also be allowed to include a magnetic body, resulting in a magnetic toner. In this case, the magnetic body can also serve as a colorant. As the magnetic body, mention may be made of an iron oxide typified by magnetite, hematite, ferrite, or the like; a metal typified by iron, cobalt, nickel, or the like, or an alloy of the metal and a metal such as aluminum, cobalt, copper, lead, magnesium, tin, zinc, antimony, beryllium, bismuth, cadmium, calcium, manganese, selenium, titanium, tungsten, or vanadium, and a mixture thereof, or the like.

Examples of the wax may include the following.

Mention may be made of an ester of monohydric alcohol such as behenyl behenate, stearyl stearate, or palmityl palmate and an aliphatic monocarboxylic acid, or an ester of a monovalent carboxylic acid and an aliphatic monoalcohol; an ester of a dihydric alcohol such as dibehenyl sebacate or hexanediol dibehenate and an aliphatic monocarboxylic acid, or an ester of a bivalent carboxylic acid and an aliphatic monoalcohol; an ester of a trihydric alcohol such as glycerin tribehenate and an aliphatic monocarboxylic acid, or an ester of trivalent carboxylic acid and an aliphatic monoalcohol; an ester of a tetrahydric alcohol such as pentaerythritol tetrastearate, or pentaerythritol tetrapalmitate and an aliphatic monocarboxylic acid ester, or an ester of a tetravalent carboxylic acid and an aliphatic monoalcohol; an ester of a hexahydric alcohol such as dipentaerythritol hexastearate or dipentaerythritol hexapalmitate and an aliphatic monocarboxylic acid, or an ester of hexavalent carboxylic acid and an aliphatic monoalcohol; an ester of a polyhydric alcohol such as polyglycerinbehenate and an aliphatic monocarboxylic acid, or an ester of a polyvalent carboxylic acid and an aliphatic monoalcohol; natural ester wax such as Carnauba wax or rice bran wax; petroleum type wax such as paraffin wax, microcrystalline wax, or petrolatum, and a derivative thereof; a hydrocarbon wax by the Fischer-Tropsch method, and a derivative thereof; a polyolefine wax such as a polyethylene wax or a polypropylene wax, and a derivative thereof; a higher aliphatic alcohol; a fatty acid such as stearic acid or palmitic acid; or an acid amide wax.

The content of the wax is preferably at least 0.5 part by mass and not more than 20.0 parts by mass for every 100 parts by mass of the binder resin.

The toner may include various organic or inorganic fine particles externally added to the toner particle in such a degree as not to impair the characteristics or the effects. As the organic or inorganic fine particles, for example, the following ones are used.

(1) Flowability-imparting agent: silica, alumina, titanium oxide, carbon black, and carbon fluoride.

(2) Abrasive: Metal oxides (e.g., strontium titanate, cerium oxide, alumina, magnesium oxide, and chromium oxide), nitrides (e.g., silicon nitride), carbides (e.g., silicon carbide), and metal salts (e.g., calcium sulfate, barium sulfate, and calcium carbonate).

(3) Lubricants: Fluorine type resin fine particles (e.g., vinylidene fluoride, and polytetrafluoroethylene), fatty acid metal salts (e.g., zinc stearate, and calcium stearate).

(4) Charge controllable particles: metal oxides (e.g., tin oxide, titanium oxide, zinc oxide, silica, and alumina), and carbon black.

The organic or inorganic fine particle can also be subjected to a hydrophobic treatment. As the treatment agents of the hydrophobic treatment of the organic or inorganic fine particle, mention may be made of unmodified silicone varnish, various modified silicone varnishes, unmodified silicone oil, various modified silicone oils, a silane compound, a silane coupling agent, other organosilicon compounds, and organotitanium compounds. The treatment agents may be used singly alone or in combination.

Measuring Method of Each Physical Property of Toner

Below, the measuring method of each physical property value will be described.

Measuring Method of Weight-average Particle Diameter (D4) and Number-Average Particle Diameter (D1) of Toner Particle and the Like The weight-average particle diameters (D4), and the number-average particle diameters (D1) of a toner base particle, a toner particle, or a toner (which will be hereinafter described merely as a toner particle in the description of the measuring method) are calculated in the following manner.

As the measuring device, a precision particle size distribution measuring device equipped with a 100-μm aperture tube by the pore electrical resistance method "Coulter/counter Multisizer 3" (registered trademark, manufactured by Beckman/Coulter Co., Ltd.) is used. For setting of the measurement conditions and analysis of the measured data, the included dedicated software "Beckman/Coulter Multisizer 3 version 3.51" (manufactured by Beckman/Coulter Co., Ltd.) is used. Incidentally, the measurement is performed at an effective measurement channel number of 25000. For the aqueous electrolytic solution for use in the measurement, the one obtained by dissolving guaranteed reagent sodium chloride in ion exchanged water to a concentration of 1.0%, for example, "ISOTON II" (manufactured by Beckman/Coulter Co., Ltd.) can be used.

Incidentally, before performing measurement and analysis, the dedicated software is set in the following manner. In the screen "Change of standard measurement method (SOMME)" of the dedicated software, the total count of the control mode is set at 50,000 particles, and the number of measurements is set at one, and for the Kd value, the value obtained by using "standard particle 10.0 μm" (manufactured by Beckman/Coulter Co., Ltd.) is set. By pushing a "measurement button of threshold value/noise level", the threshold value and the noise level are automatically set. Further, the current is set at 1,600 μA, the gain is set at 2, and the aqueous electrolytic solution is set at ISOTON II, and "Flush of aperture tube after measurement" is checked. In the screen "Conversion setting from pulse to particle diameter" of the dedicated software, the bin interval is set at a logarithm particle size, the particle size bin is set at 256 particle size bin, and the particle size range is set at from 2 μm to 60 μm.

The specific measuring method is as follows.

(1) A 250-mL round bottom beaker made of glass exclusively designated to Multisizer 3 is charged with 200.0 mL of the aqueous electrolytic solution, and is set at a sample stand. Thus, stirring with a stirrer rod is performed counterclockwise at 24 rotations/sec. Then, the stain and bubbles in the aperture tube are removed by the "Aperture tube flush" function of the dedicated software.

(2) A 100-mL flat bottom beaker made of glass is charged with 30.0 mL of the aqueous electrolytic solution. Thereinto, 0.3 mL of a diluent obtained by diluting "Contaminon N" (10% aqueous solution of a pH-7 neutral detergent for precision measuring device cleaning including a nonionic surfactant, an anionic surfactant, and an organic builder manufactured by Wako Pure Chemical Industries, Ltd.) to 3 mass fold with ion exchanged water is added as a dispersing agent.

(3) An ultrasonic dispersing unit "Ultrasonic Dispersion System Tetora 150" (manufactured by Nikkaki Bios Co., Ltd.) internally including two oscillators each having an oscillatory frequency of 50 kHz with the phase shifted by 180° and having an electrical output of 120 W is prepared. The water tank of the ultrasonic dispersing unit is charged with 3.3 L of ion exchanged water, and 2.0 mL of Contaminon N is added into the water tank.

(4) The beaker in the section (2) is set in the beaker fixing hole of the ultrasonic dispersing unit, and the ultrasonic dispersing unit is operated. Then, the height position of the beaker is adjusted so as to maximize the resonance state of the liquid level of the aqueous electrolytic solution in the beaker.

(5) Ten milligrams of the toner particle is added to and dispersed little by little in the aqueous electrolytic solution in the section (4) with the aqueous electrolytic solution in the beaker being irradiated with an ultrasonic wave. Then, the ultrasonic dispersion treatment is continued for additional 60 seconds. Incidentally, the temperature of water in the water tank is appropriately adjusted so as to be at least 10° C. and not more than 40° C. for ultrasonic dispersion.

(6) The aqueous electrolytic solution in the section (5) including the toner particle dispersed therein is added dropwise with a pipette to the round bottom beaker in the section (1) placed in the sample stand, and the resulting mixture is adjusted to a measurement concentration of 5%. Then, the measurement is performed until the number of particles measured becomes 50,000.

(7) The measurement data is analyzed with the dedicated software included with the device, and the weight-average particle diameter (D4) and the number-average particle diameter (D1) are calculated. Incidentally, the "average diameter" on the analysis/volume statistic value (arithmetic average)" screen when the dedicated software is set to show data in graph/vol % is the weight-average particle diameter (D4), and the "average diameter" on the analysis/number statistic value (arithmetic average)" screen when the dedicated software is set to show data in graph/number % is the number-average particle diameter (D1).

Calculation Method of Ratio M1 and M2 of Metal Element M Using X-Ray Photoelectron Spectroscopy Treatment (a)

To 100 mL of ion exchanged water, 160 g of sucrose (manufactured by KISHIDA CHEMICAL Co., Ltd.) is added, and dissolved while being warmed in hot bath, thereby preparing a 61.5% cane sugar aqueous solution. The tube for centrifugation is charged with 31.0 g of the cane sugar concentrate, and 6 g of Contaminon N (trade name) (10 mass % aqueous solution of a pH-7 neutral detergent for precision measuring device cleaning including a nonionic surfactant, an anionic surfactant, and an organic builder, manufactured by Wako Pure Chemical Industries), thereby manufacturing a dispersion. To the dispersion, 1.0 g of toner is added, and the lump of the toner is loosened by a spatula, or the like. The tube for centrifugation is oscillated by a shaker at 300 spm (strokes per min), for 20 minutes. After oscillation, the solution is substituted for the contents of a glass tube for swing rotor (50 mL), and is separated by means of a centrifugal separator under the conditions of 3500 rpm and for 30 minutes. Sufficient separation between the toner and the aqueous solution is visually observed, and the toner separated at the uppermost layer is collected by a spatula or the like. The collected toner is filtrated by a vacuum filter, followed by drying by a dryer for one hour or more. The dried product is crushed by a spatula, resulting in a toner (a).

As for the toner of the present invention, the toner (a), using a X-ray photoelectron spectroscopy, the measurement is performed in the following manner, thereby calculating the M1 and M2. The ratio M1 and the ratio M2 of the metal element M are calculated by measuring the toner under the following conditions.

Measuring device: X-ray photoelectron spectrometer: Quantum 2000 (manufactured by ULVAC-PHI INC., Ltd)

X-ray source: monochrome Al Kα

X-ray Setting: 100 μmφ (25 W (15 KV))

Photoelectron take-off angle: 45 degrees

Neutralization condition: use of neutralizer and an ion gun in combination

Analysis area: 300×200 μm

Pass Energy: 58.70 eV

Step size: 0.1.25 eV

Analysis software: Multipak (PHI Co.)

Herein, for example, for calculation of the quantitative value of a Ti atom, the peak of Ti 2p (B. E. 452 to 468 eV) is used. The quantitative value of the Ti element herein obtained is referred to as M1 (at %).

Using the foregoing method, the toner of the present invention and the toner (a) are measured, so that the ratios of the metal element M of respective toners are referred to as M1 (at %) and M2 (at %), respectively.

Detection Method of Reactant of a Polyhydric Acid and a Compound Containing a Group 4 Element Using the Time of Flight Secondary ion mass spectrometry (TOF-SIMS), the reactant of a polyhydric acid and a compound containing a group 4 element (preferably a polyhydric acid metal salt) on the toner surface is detected in the following manner. Each toner sample is analyzed using a TOF-SIMS (TRIFTIV: manufactured by ULVAC-PHI INC., Ltd) under the following conditions.

Primary ion species: gold ion ($Au^+$)
Primary ion current value: 2 pA
Analysis area: 300×300 $\mu m^2$
Number of pixels: 256×256 pixels
Analysis time: 3 min
Repeating frequency: 8.2 kHz
Charging neutralization: ON
Secondary ion polarity: Positive
Secondary ion mass range: m/z 0.5 to 1850
Sample substrate: indium Analysis is performed under the foregoing conditions. When the peak derived from secondary ions including a group 4 metal ion and a polyhydric acid ion (e.g., $TiPO_3$ (m/z 127) or $TiP_2O_5$ (m/z 207) for titanium phosphate) is detected, it is assumed that the reactant of a polyhydric acid and a compound containing a group 4 element is present on the toner surface.

Measurement Method of Number-Average Particle Diameter of Primary Particles of Silica-Containing Fine Particles The measurement of the number-average particle diameter of primary particles of silica-containing fine particles is performed using a scanning electron microscope "S-4800" (trade name; manufactured by Hitachi Ltd.). The toner including a silica-containing fine particle added therein is observed. In the visual field enlarged to a maximum of 50000 times, the major axes of 100 primary particles of silica-containing fine particles are measured at random, thereby determining the number-average particle diameter. The observation magnification is appropriately adjusted according to the size of the silica-containing fine particle.

Observation of Protruded Portion of Organosilicon Polymer and the Reactant of a Polyhydric Acid and a Compound Containing a Group 4 Element on the Protruded Portion Surface Using a transmission electron microscope (TEM), the cross section of the toner is observed by the following method. First, a toner is sufficiently dispersed in an normal-temperature curable epoxy resin, followed by curing under a 40° C. atmosphere for 2 days. A flake-shaped sample with a thickness of 50 nm is cut out from the resulting cured product using a microtome (EM UC7: manufactured by LEICA Co.) equipped with a diamond blade.

With the sample, the cross section of the toner is observed on an enlarged scale of 500000 magnifications under the conditions of an acceleration voltage of 200 V and an electron beam probe size of 1 mm using a TEM (JEM2800 model: manufactured by JEOL Ltd.). At this step, according to a measurement method of the number-average particle diameter (D1) of a toner described later, the cross section of the toner having the maximum diameter 0.9 times to 1.1 times the number-average particle diameter (D1) upon measuring the same toner is selected.

Subsequently, the constituent element of the cross section of the toner obtained is analyzed using the Energy dispersive X-ray spectroscopy (EDX), thereby manufacturing an EDX mapping image (256×256 pixels (2.2 nm/pixel), cumulative number 200). When in the manufactured EDX mapping image, a signal derived from a silicon element is observed on the surface of the toner base particle, and the signal is confirmed to be derived from an organosilicon polymer by a confirmation method of an organosilicon polymer described layer, the signal is referred to as an image of an organosilicon polymer. Further, when an image of an organosilicon polymer is continuously observed on the surface of the toner base particle, the line segment connecting the endpoints of the image of the organosilicon polymer is referred to as a base line. Incidentally, the portion at which the strength of the signal derived from silicon is equal to the silicon strength of the background is referred to as the endpoint of the image of the organosilicon polymer.

For each base line, the perpendicular taking the maximum length of the perpendiculars from the base line to the image surface of the organosilicon polymer is looked for, and the maximum length is referred to as H. The protruded portion is preferably an image including an organosilicon polymer having the image height H of at least 30 nm and not more than 300 nm. The length of the convex base line is measured with the base line of the protruded portion as the convex base line, and is referred to as a convex width W. The arithmetic average value of the convex width W is preferably at least 20 nm and not more than 500 nm.

Further, in the EDX mapping image, the protruded portion is preferably present in a semi-circular shape. The semi-circular shape may only be a shape having a curved surface and close to a semi-circular shape, and also includes generally a semi-circular shape. The semi-circular shapes include, for example, a semi-perfect circular shape and a semi-elliptic shape. The semi-circular shape includes the one cut along a straight line passing through the center of a circle, namely, the shape obtained by halving a circle. Further, the semi-circular shapes also include the one cut along a straight line not passing through the center of a circle, namely, a larger shape than the half of a circle as well as a smaller shape than the half of a circle.

The presence of the reactant of a polyhydric acid and a compound containing a group 4 element on the toner surface is confirmed by the TOF-SIMS. Further, when for the protruded portion, a signal derived from a metal of the reactant of a polyhydric acid and a compound containing a group 4 element is observed on the surface, it is judged that the reactant of a polyhydric acid and a compound containing a group 4 element is present on the surface of the protruded portion.

Confirmation Method of Organosilicon Polymer

The organosilicon polymer on the toner particle surface is confirmed by comparison between the ratio of the element contents (atomic %) of Si and O (Si/O ratio) and that of a sample. For respective samples of an organosilicon polymer and a silica fine particle, EDX analysis is performed under the conditions described in the item "Observation of protruded portion of organosilicon polymer and the reactant of a polyhydric acid and a compound containing a group 4 element on the protruded portion surface", thereby obtaining respective element contents (atomic %) of Si and O.

A represents the Si/O ratio of a organosilicon polymer, and B represents the Si/O ratio of a silica fine particle. The measurement conditions such that A is significantly larger than B are selected. Specifically, for the samples, measurement is performed under the same conditions 10 times, thereby obtaining A and B, and respective arithmetical mean values. The measurement conditions such that the resulting mean values satisfy A/B>1.1 are selected. When the Si/O ratio of the portion at which silicon observed at the toner cross section observed in the item of "Observation of protruded portion of organosilicon polymer and the reactant of a polyhydric acid and a compound containing a group 4 element on the protruded portion surface" is detected is present closer to the A side than [(A+B)/2], the portion is judged as an organosilicon polymer. As the sample of an organosilicon polymer particle, Tospal 120A (Momentive Performance Materials Japan Consolidated Company) is used, and as the sample of a silica fine particle, HDK V15 (Asahi Kasei Corporation) is used.

Manufacturing Example of Toner

Below, "part" and "%" are all based on mass unless otherwise specified.

Manufacturing Example of Polyhydric Acid Metal Salt Fine Particle

Ion exchanged water 100.0 parts

Sodium phosphate (12 hydrates) 8.5 parts

The components described up to this point are mixed, and then, with stirring at 10,000 rpm at room temperature using a T. K. homo mixer (manufactured by PRIMIX Corporation), 60.0 parts (equal to 7.2 parts of zirconium lactate ammonium salt) of zirconium lactate ammonium salt (ZC-300, Matsumoto Fine Chemical Co. Ltd.) were added. Thereto, 1.0 mol/L hydrochloric acid was added to adjust the pH to 7.0. With the temperature adjusted to 70° C., and with stirring kept, the reaction was effected for 1 hour.

Thereafter, the solid content was extracted by centrifugation. Subsequently, a step of dispersing the solid content in ion exchanged water again, and extracting the solid content by centrifugation is repeated 3 times, thereby removing ions of sodium or the like. Again, the solid content was dispersed in ion exchanged water, and was dried by spray drying, resulting in a zirconium phosphate compound fine particle with a number-average particle diameter of 22 nm.

Manufacturing Example of Toner Base Particle Dispersion

Into a reaction vessel charged with 390.0 parts of ion exchanged water, 11.2 parts of sodium phosphate (12 hydrates) was charged, and was kept warm at 65° C. for 1.0 hour with nitrogen purging. Using a T. K. homo mixer (manufactured by PRIMIX Corporation), stirring was performed at 12,000 rpm. With stirring kept, a calcium chloride aqueous solution obtained by dissolving 7.4 parts of calcium chloride (2 hydrates) in 10.0 parts of ion exchanged water was charged all together into the reaction vessel, thereby preparing an aqueous medium including a dispersion stabilizer. Further, a 1.0 mol/L hydrochloric acid was charged into the aqueous medium in the reaction vessel to adjust the pH to 6.0, thereby preparing an aqueous medium.

Preparation of Polymerizable Monomer Composition

Styrene: 60.0 parts

Carbon black (Nipex 35: manufactured by Orion Engineered Carbons Co.): 6.3 parts The materials were charged into an attritor (manufactured by NIPPON COKE & ENGINEERING Co., LTD), and further dispersed at 220 rpm for 5.0 hours using a zirconia particle with a diameter of 1.7 mm, thereby preparing a colorant dispersion including a pigment dispersed therein.

Then, the following materials were added to the colorant dispersion.

Styrene 10.0 parts

N-butyl acrylate 30.0 parts

Polyester resin 5.0 parts (a condensation polymeric substance of terephthalic acid and propylene oxide 2 mol adduct of bisphenol A, weight-average molecular weight Mw=10,000, acid value: 8.2 mg KOH/g)

HNP 9 (melting point: 76° C., manufactured by NIPPON SEIRO Co., Ltd.) 6.0 parts

The materials were kept warm at 65° C., and is uniformly dissolved and dispersed at 500 rpm using a T. K. homo mixer, thereby preparing a polymerizable monomer composition.

Granulating Step

With the temperature of the aqueous medium kept at 70° C., and the number of revolutions of a stirrer kept at 12,000 rpm, the polymerizable monomer composition was charged into the aqueous medium, and 8.0 parts of t-butylperoxy pivalate of a polymerization initiator was added thereto. Granulation was performed for 10 minutes while keeping 12,000 rpm as it is by a stirrer.

Polymerizing Step

The stirrer was changed from the high speed stirrer to a stirrer equipped with a propeller stirring blade, and the temperature was kept at 70° C. with stirring at 200 rpm. Thus, polymerization was performed for 5.0 hours. Further, the temperature was increased to 85° C., and heating was performed for 2.0 hours, thereby performing a polymerization reaction. Further, the temperature was increased to 98° C., and heating was performed for 3.0 hours, thereby removing the residual monomer. Ion exchanged water was added thereto, to adjust the toner base particle concentration in the dispersion to 30.0 mass %, resulting in a toner base particle dispersion including a toner base particle dispersed therein. The number-average particle diameter (D1) of the toner base particle was 6.2 μm, and the weight-average particle diameter (D4) thereof was 6.9 μm.

Manufacturing Example of Organosilicon Compound Solution

Ion exchanged water 70.0 parts

Methyl triethoxy silane 30.0 parts

The materials were weighed in a 200-mL beaker, and the pH was adjusted to 3.5 with 10% hydrochloric acid. Thereafter, with heating in a water bath at 60° C., stirring was performed for 1.0 hour, thereby manufacturing an organosilicon compound solution.

Toner 1: Example 1

Polyhydric Acid Metal Salt Depositing Step

The following samples were weighted in a reaction vessel, and were mixed using a propeller stirring blade.

Toner base particle dispersion 500.0 parts

44% aqueous solution of titanium lactate (TC-310: manufactured by Matsumoto Fine Chemical Co. Ltd.) 3.2 parts (equivalent to 1.4 parts as titanium lactate)

Organosilicon compound solution 10.0 parts

Then, using a 1.0 mol/L NaOH aqueous solution, the pH of the resulting mixed solution was adjusted to 9.5, and the solution was kept for 5.0 hours. After reducing the temperature to 25° C., the pH was adjusted to 1.5 with 1.0 mol/L hydrochloric acid, and stirring was performed for 1.0 hour. Then, filtration was performed with cleaning with ion exchanged water. The resulting powder was dried by a thermostat, followed by classification by an air classifier, resulting in a toner particle 1. The number-average particle diameter (D1) of the toner particle 1 was 6.2 μm, and the weight-average particle diameter (D4) thereof was 6.9 μm. The toner particle 1 was subjected to TOF-SIMS analysis, so that ions derived from titanium phosphate were detected.

Incidentally, the titanium phosphate compound is the reactant of titanium lactate, and phosphoric acid ions derived from sodium phosphate, or calcium phosphate in the aqueous medium. The toner particle 1 was used as the toner 1 of the present example.

Toner 2: Example 2

A toner particle 2 was obtained in the same manner as in the manufacturing example of the toner 1, except that 44% aqueous solution of titanium lactate (TC-310: manufactured by Matsumoto Fine Chemical Co. Ltd.) was added in an amount of 4.3 parts (equivalent to 1.9 parts as titanium lactate) in place of 3.2 parts in the manufacturing example of the toner 1. The number-average particle diameter (D1) of the toner particle 2 was 6.2 μm, and the weight-average particle diameter (D4) thereof was 6.9 μm. The toner particle 2 was subjected to TOF-SIMS analysis, so that ions derived from titanium phosphate were detected. The toner particle 2 was used as the toner 2 of the present example.

Toner 3: Example 3

A toner particle 3 was obtained in the same manner as in the manufacturing example of the toner 1, except that 44% aqueous solution of titanium lactate (TC-310: manufactured by Matsumoto Fine Chemical Co. Ltd.) was added in an amount of 2.1 parts (equivalent to 0.9 part as titanium lactate) in place of 3.2 parts in the manufacturing example of the toner 1. The number-average particle diameter (D1) of the toner particle 3 was 6.2 μm, and the weight-average particle diameter (D4) thereof was 6.9 μm. The toner particle 3 was subjected to TOF-SIMS analysis, so that ions derived from titanium phosphate were detected. The toner particle 3 was used as the toner 3 of the present example.

Toner 4: Example 4

A toner particle 4 was obtained in the same manner as in the manufacturing example of the toner 1, except that 11.7 parts (equivalent to 1.4 parts as a zirconium lactate ammonium salt) of zirconium lactate ammonium salt (ZC-300, Matsumoto Fine Chemical Co. Ltd.) was added in place of 3.2 parts of 44% aqueous solution of titanium lactate (TC-310: manufactured by Matsumoto Fine Chemical Co. Ltd.) in the manufacturing example of the toner 1. The number-average particle diameter (D1) of the toner particle 4 was 6.2 μm, and the weight-average particle diameter (D4) thereof was 6.9 μm. The toner particle 4 was subjected to TOF-SIMS analysis, so that ions derived from zirconium phosphate were detected. Incidentally, the zirconium phosphate compound is the reactant of a zirconium lactate ammonium salt and phosphoric acid ions derived from sodium phosphate, or calcium phosphate in the aqueous medium. The toner particle 4 was used as the toner 4 of the present example.

Toner 5: Example 5

The following sample was weighed in a reaction vessel, and was mixed using a propeller stirring blade.

Toner base particle dispersion 500.0 parts

Then, while keeping the temperature to 25° C., the pH was adjusted to 1.5 with 1.0 mol/L hydrochloric acid, and stirring was performed for 1.0 hour. Then, filtration was performed with cleaning with ion exchanged water. The resulting powder was dried by a thermostat, followed by classification by an air classifier, resulting in a toner particle 5.

Toner particle 5 100.0 parts

Hydrophobic silica fine particle (hexamethyl disilazane treatment: number-average particle diameter 12 nm) 1.0 part Zirconium phosphate compound fine particle 1.5 parts The materials were charged into a SUPERMIXER PICCOLO SMP-2 (manufactured by KAWATA MFG. CO., LTD.), and were mixed at 3,000 rpm for 20 minutes. Thereafter, the resulting mixture was filtrated through a mesh with an opening of 150 μm, resulting in a toner 5. The number-average particle diameter (D1) of the toner 5 was 6.2 μm, and the weight-average particle diameter (D4) thereof was 6.9 μm. The toner 5 was subjected to TOF-SIMS analysis, so that ions derived from zirconium phosphate were detected.

Toner 6: Comparative Example: Conventional Toner Example

In the manufacturing example of a toner 6, in place of a zirconium phosphate compound fine particle, 1.5 parts of a titanium oxide fine particle with a number-average particle diameter of 28 nm was charged into a SUPERMIXER PICCOLO SMP-2 (manufactured by KAWATA MFG. CO., LTD.), and was mixed at 3,000 rpm for 20 minutes. Thereafter, the resulting mixture was filtrated through a mesh with an opening of 150 μm, resulting in a toner 6. The toner 6 was subjected to TOF-SIMS analysis, so that ions derived from a polyhydric acid metal salt were not detected.

The physical properties of the resulting toners 1 to 6 are shown in Table 1.

| | Reactant of polyhydric acid and compound containing group 4 element | Organic silicon polymer | M1 (at %) | M2/M1 |
|---|---|---|---|---|
| Toner 1 | Titanium phosphate | Y | 3.50% | 0.99 |
| Toner 2 | Titanium phosphate | Y | 4.70% | 0.99 |
| Toner 3 | Titanium phosphate | Y | 2.30% | 0.99 |
| Toner 4 | Zirconium phosphate | Y | 3.50% | 0.99 |
| Toner 5 | Zirconium phosphate | N | 4.20% | 0.5 |
| Toner 6 | None (titanium oxide) | N | — | — |

Confirmation of Volume Resistivities Before and After Fixing of Toner for Use in the Present Invention First, in order to confirm the characteristics of the toners of the present invention, with the toner 1 and the toner 6, using the image forming apparatus, on Vitality Multipurpose Papers manufactured by Xerox Co., as a recording material, with a Letter size, and a basis weight of 75 g/m$^2$, solid black images each with an amount of stuck toner of 0.4 mg/cm$^2$ were formed, thereby forming a sample being unfixed and a sample after fixing.

As the fixing conditions, as one example of the image forming apparatus, an image forming apparatus was used which has a productivity of printing 40 recording materials with a LTR longitudinal size per minute at a process speed of about 200 mm/sec. The inter-paper period distance in this case is about 20 mm. Using a fixing film with a diameter of about Φ18, and using a pressure roller with a diameter of Φ22, a fixing nip width of about 7 to 8 mm was obtained with a pressing force of about 22 Kgf.

The fixing temperature was varied, thereby forming samples different in toner molten state at the fixing nip portion. Then, for the samples, using a high resistance meter Hiresta-UP MCP-HT450 model manufactured by Diainstruments Co., Ltd., and a measuring probe URS manufactured by the same company, under the environment of 23° C. and 50% RH, under the conditions of a probe pressing force of 10.8 N (1.1 kgf), an applied voltage of 100 V, and an application time of 10 seconds, the volume resistivity (Ω·cm) was measured. The volume resistivity of the unfixed image is referred to as Tv, and the volume resistivity of the image after fixing is referred to as Fv.

Incidentally, for the sample immediately after fixing, the variation in resistance is large, and hence the sample was sufficiently allowed to stand (for about 72 h) under the same environment, and then the resistance measurement was performed. The measurement results are as shown in Table 2.

TABLE 2

| Volume resistivity (Ω · cm) | | | | |
|---|---|---|---|---|
| | Fixing temperature | Toner 1 | Toner 6 | Recording material |
| Tv (unfixed) | (23° C.) | 2.1 × 10^12 | 4.8 × 10^12 | 1.5 × 10^8 |
| Fv (after fixing) | About 155° C. | 4.3 × 10^11 | 2.1 × 10^11 | 1.5 × 10^8 |
| | About 165° C. | 5.0 × 10^9 | 8.3 × 10^10 | 1.4 × 10^8 |
| | About 175° C. | 4.4 × 10^9 | 7.1 × 10^10 | 1.6 × 10^8 |

Herein, the fixing temperature is the surface temperature of the fixing film.

Figure 5:
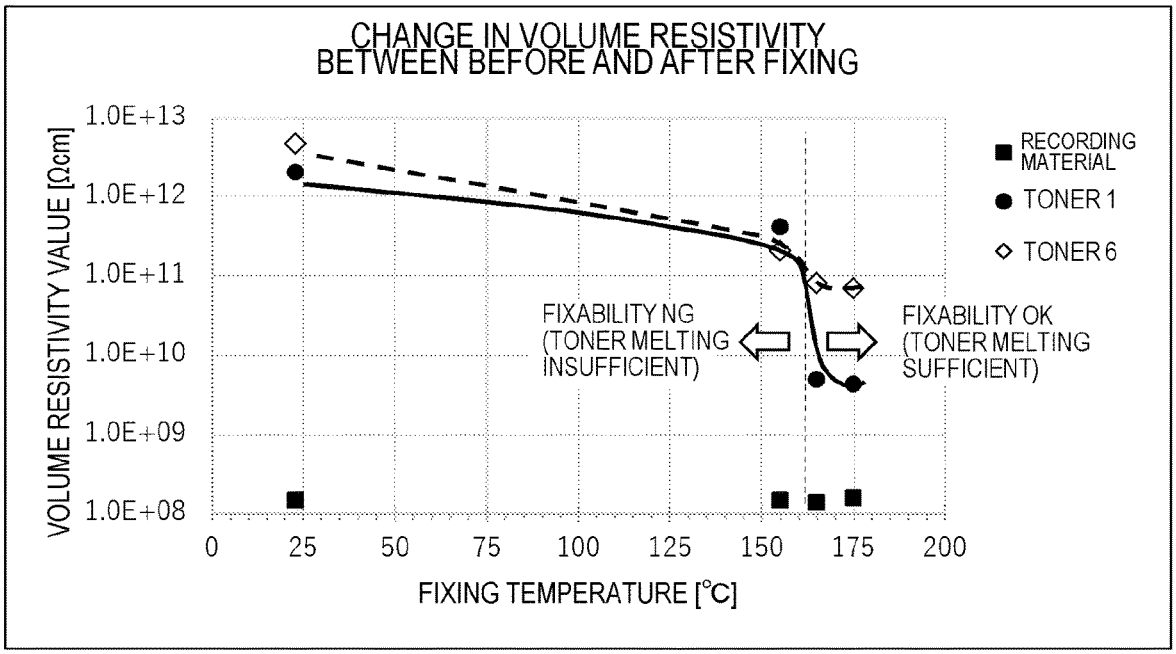
FIG. 5 is a graph of the volume resistivities before and after fixing of a toner of the present Example, a conventional toner, and a recording material.

FIG. 5 shows a graph of the measurement results of Table 2. As for the samples of a fixing temperature of 155° C., the toner has been insufficiently molten and the fixing performance was insufficient, and the samples have undergone the occurrence of so-called cold offset (for both the samples of the toner 1 and the toner 6). As for the samples of a fixing temperature of 165° C., for both the toner 1 and the toner 6, the occurrence of cold offset was not observed. The sample of a fixing temperature of 175° C. was the sample for which the fixing temperature of 165° C. was further increased by a temperature of 10° C., and the toner was sufficiently molten, and the fixing performance was also made sufficient.

When the volume resistivity was measured for a sample of a fixing temperature of 155° C., and which has undergone the occurrence of cold offset, although the volume resistivity was slightly reduced from the volume resistivity value at the time of being unfixed for both the toner 1 and the toner 6, a large difference was not observed in the volume resistivity between the toner 1 and the toner 6. For the sample of a fixing temperature of 165° C., toner melting proceeded to such an extent as to prevent the occurrence of cold offset for the toner 6 of a conventional toner. Thus, although the volume resistivity was slightly reduced from the volume resistivity value at the time of a fixing temperature of 155° C., the degree of the reduction was small.

On the other hand, for the toner 1 involved in the present invention, the toner melting proceeded to such a degree that cold offset ceases to occur, so that a large reduction of the volume resistivity from the volume resistivity value at the time of a fixing temperature of 155° C. was observed. This is considered due to the following fact: toner melting proceeded sufficiently, and the reactant of a polyhydric acid and a compound containing a group 4 element on the toner particle surface of the toner 1 was mixed with the molten toner particle; accordingly, the characteristic of facilitating transfer of electric charges into the toner particle inside is expressed; resulting in the expression of the large reduction of the volume resistivity.

As for the sample for which the fixing temperature was further increased to a fixing temperature of 175° C., for both the toner 1 and the toner 6, each toner was sufficiently molten, and there was no large change in toner melting state from the time of a fixing temperature of 165° C. Accordingly, the change in volume resistivity from the time of a fixing temperature of 165° C. was small for both the toner 1 and the toner 6.

Figure 6:
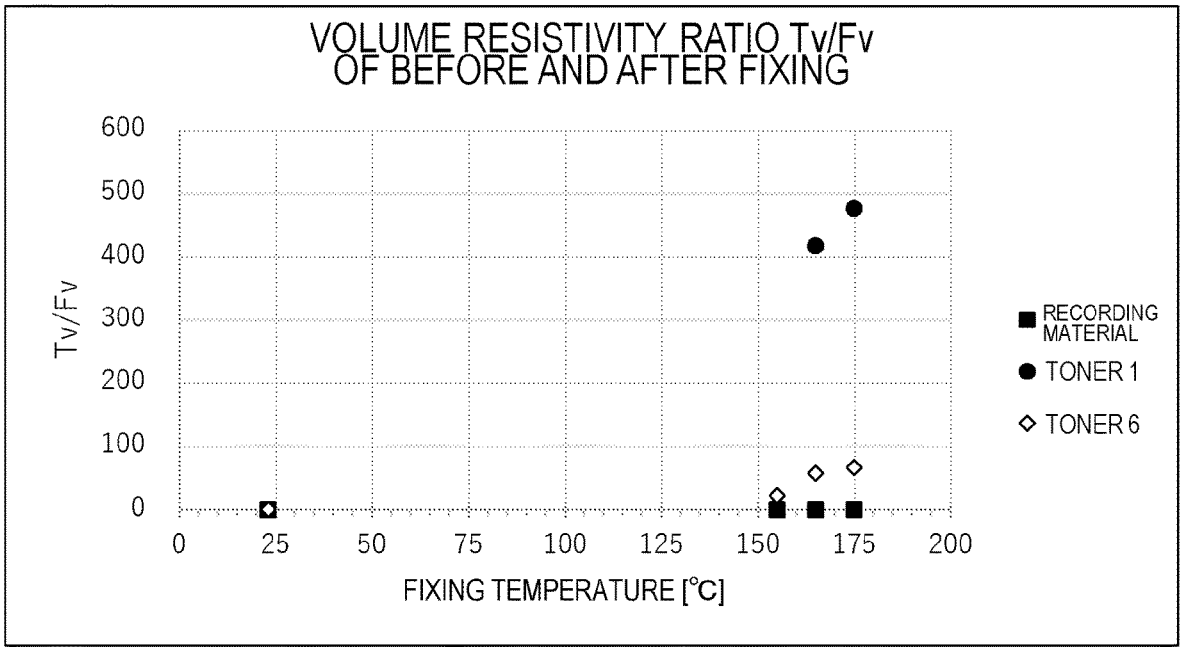
FIG. 6 is a graph of the volume resistivities before and after fixing of a toner of the present Example, a conventional toner, and a recording material.

Table 3 and FIG. 6 show the values of the volume resistivity ratios Tv/Fv of before and after fixing at respective fixing temperatures of the toner 1, the toner 6, and the recording material. The volume resistivity ratio Tv/Fv of before and after fixing is the ratio of the volume resistivity Tv of the unfixed image and the volume resistivity Fv of an image after fixing of each toner measured by the procedure described in connection with the electric resistance characteristic.

TABLE 3

| Volume resistivity ratio Tv/Fv of before and after fixing | | | | |
|---|---|---|---|---|
| | Fixing temperature | Toner 1 | Toner 6 | Recording material |
| Tv/Fv | Unfixed (23° C.) | 1 | 1 | 1 |
| | About 155° C. | 5 | 23 | 1.0 |
| | About 165° C. | 418 | 58 | 1.1 |
| | About 175° C. | 477 | 67 | 0.9 |

When the toner is not sufficiently molten, and cold offset occurs (fixing temperature of about 155° C.), the value of the volume resistivity ratio Tv/Fv of before and after fixing is small for both the toner 1 and the toner 6.

In contrast, at the time of a fixing temperature of 165 or 175° C. at which the toner is sufficiently molten, although the change in value of the volume resistivity ratio Tv/Fv of before and after fixing of the conventional toner 6 is smaller than that at the time of 155° C., the value of the volume resistivity ratio Tv/Fv of before and after fixing of the toner 1 involved in the present invention has been largely changed as compared with the time of 155° C.

The results of the same measurement performed for other toners 2 to 5 are shown in Table 4. As the value of the volume resistivity ratio Tv/Fv of before and after fixing herein, the value at the time of a fixing temperature of about 175° C. at which the toner was sufficiently molten was used.

TABLE 4

| Volume resistivity ratio Tv/Fv of before and after fixing in each toner | |
|---|---|
| Toner | Volume resistivity ratio Tv/Fv of before and after fixing |
| Toner 1 | 477 |
| Toner 2 | 272 |
| Toner 3 | 140 |
| Toner 4 | 230 |
| Toner 5 | 100 |
| Toner 6 | 67 |

Fixing Apparatus

Then, a description will be given to one example of a fixing apparatus in accordance with the present embodiment of the present invention. In the present embodiment, a fixing apparatus of a film heating system is used.

Figure 3:
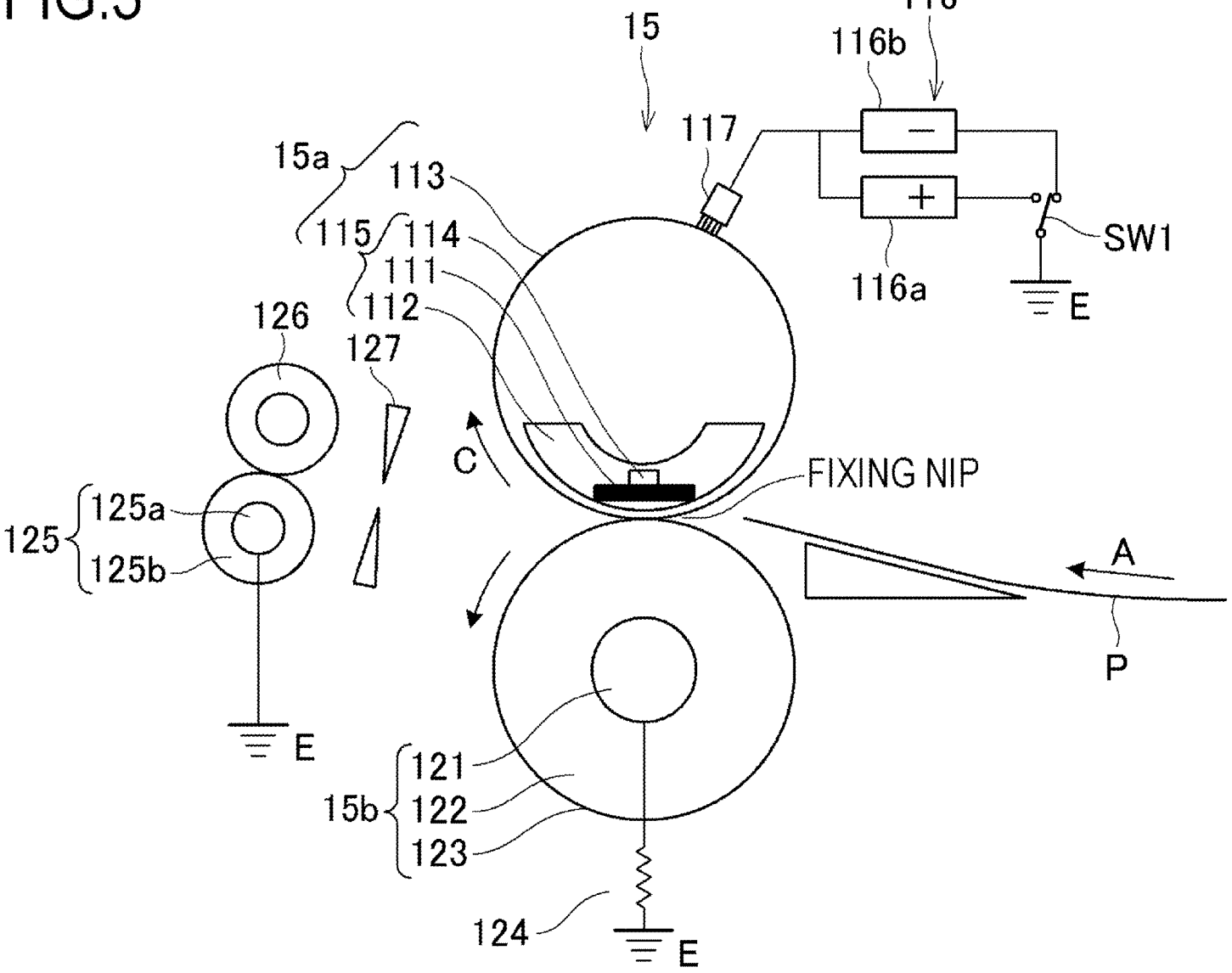
FIG. 3 is a schematic view of a fixing apparatus of the present embodiment.

FIG. 3 shows a schematic view of a fixing apparatus. The fixing apparatus includes a fixing unit 15 of a fixing film system, a discharge rubber roller 125, a discharge roller 126, a control portion 130 (not shown), and a variable bias applying portion 116, and the like. The fixing unit 15 includes a film unit 15*a* as a heating unit for heating a recording material P having a toner image formed thereon, a pressure roller 15*b* as a pressure unit for fixing the toner image on the recording material P while interposing, and rotationally transporting the recording material P with the film unit 15*a*, and the like. In the fixing unit 15, a heater included in the fixing film unit 15*a*, and a pressure roller 15*b* as a pressure member to come in pressure contact with the outer surface of the fixing film 113 form a fixing nip portion via a fixing film 113 included in the film unit 15*a*. A recording material P having an unfixed toner image (developer image) is passed through the fixing nip portion, thereby fixing the toner image on the recording material P.

Figure 4A:
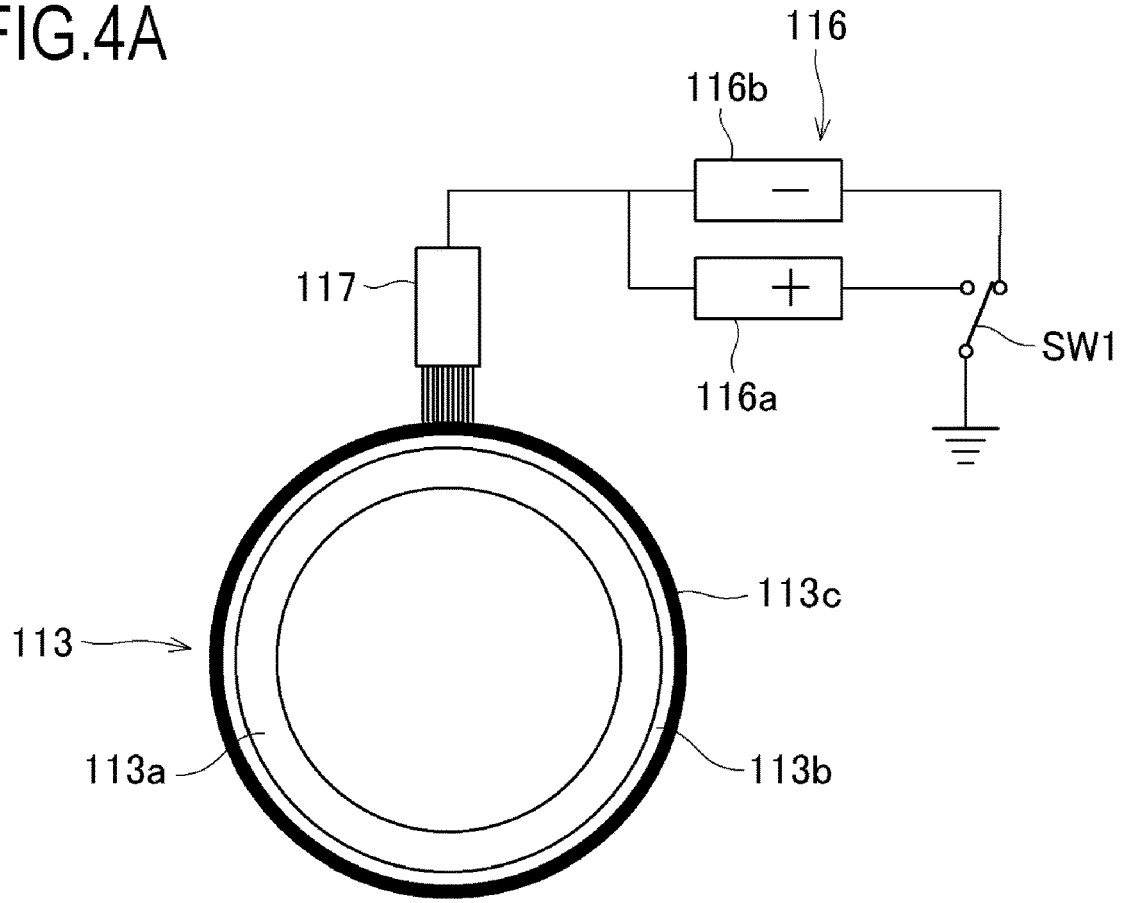
FIGS. 4A and 4B are schematic views of a high pressure bias feeding method to a fixing member of the present embodiment.
Figure 4B:
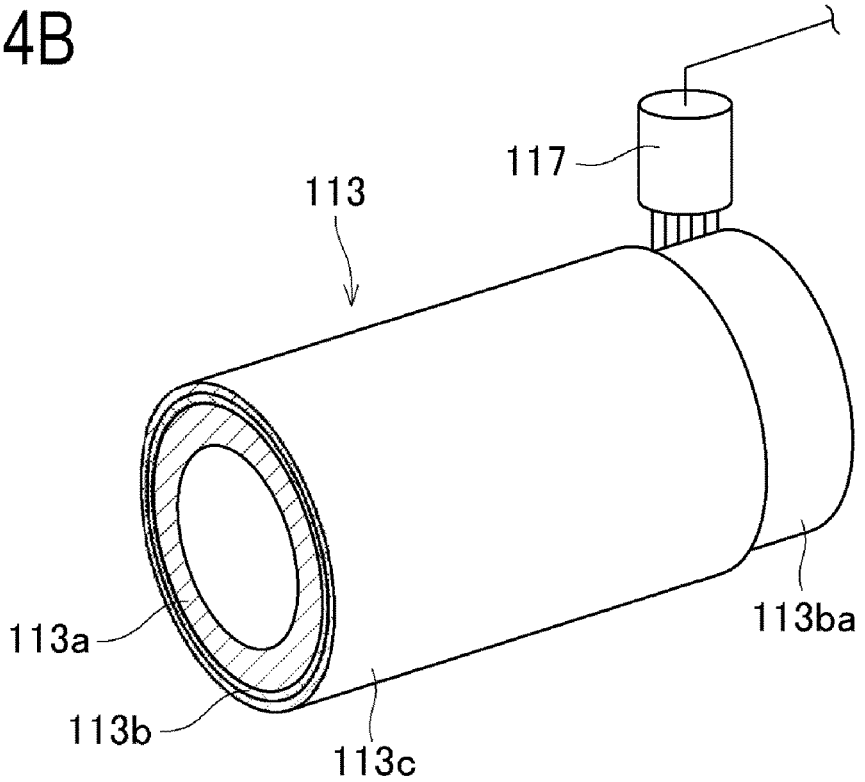

FIGS. 4A and 4B show one example of the configuration of the fixing film 113 and one example of a bias feeding configuration. The fixing film 113 shown in FIG. 3 is a film member having a small heat capacity, in an endless shape (tubular shape), as shown in FIGS. 4A and 4B, and having a heat resistance and flexibility, and has a total thickness of about 20 μm to about 100 μm optimum for the quick starting property, Further, the fixing film 113 is formed in a multiple-layered structure including a base layer 113*a*, a conductive primer layer 113*b*, and a release layer 113*c* stacked sequentially from the inner side as shown in FIGS. 4A and 4B. The base layer 113*a* is formed of a heat resistant resin such as polyimide, polyamideimide, or PEEK, or a metal member such as SUS, Al, Ni, Ti, or Zn having a heat resistance value and a high thermal conductivity singly or in combination.

The base layer 113*a* made of a resin may include a high thermal conductivity powder such as BN, alumina, Al, or CF (carbon fiber filler) mixed therein in order to improve the thermal conductivity. Further, in order to extend the life of the fixing film 113, the base layer 113*a* is required to have sufficient strength and durability, and preferably has a thickness equal to, or larger than 20 μm in total thickness.

On the outer side of the base layer 113*a* of the fixing film 113, the conductive primer layer 113*b* is formed. The conductive primer layer 113*b* includes a conductivity imparting member such as carbon black dispersed therein, and has a resistivity set at $1\times10^5$ Ω·cm or less, and a thickness set at about 2 μm to about 10 μm. Incidentally, in the present embodiment, the conductive primer layer 113*b* is formed of a conductive member. Of the base layer 113*a* and the conductive primer layer 113*b*, preferably, at least the conductive primer layer 113*b* is formed of a conductive member.

On the outer side of the conductive primer layer 113*b*, as a surface layer, the release layer 113*c* is formed. The release layer 113*c* is the layer to be in direct contact with the unfixed toner image on a sheet. In order to prevent the offset of the toner, and improve the separability from the sheet, a material excellent in release property is used. As the release layer 113*c*, PTFE (polytetrafluoroethylene), PFA (tetrafluoroethylene perfluoroalkyl vinyl ether copolymer), FEP (tetrafluoroethylene-hexafluoropropylene copolymer), or the like is usable.

Further, other than these, a fluorine resin such as ETFE (ethylene tetrafluoroethylene copolymer), CTFE (polychlorotrifluoroethylene), or PVDF (polyvinylidene fluoride) may be used in mixture or singly. Furthermore, a heat resistant resin good in release property such as a silicone resin may be used in mixture or singly. Still further, the release layer 113*c* includes a conductive member such as carbon black or an ion conductive substance mixed therein, and preferably has a resistivity of about $1\times10^7$ Ω·cm to about $1\times10^{12}$ Ω·cm, and a thickness of about 5 μm to about 20 μm. Whereas, examples of the method for coating the release layer 113*c* may include the method in which the conductive primer layer 113*b* also having a function as an adhesive is coated on the outer surface of the base layer 113*a*, and the release layer 113*c* is coated.

The image forming apparatus of the present embodiment is a monochrome printer. For this reason, an elastic layer is not particularly provided on the fixing film of the fixing member of the fixing apparatus.

As shown in FIG. 3, in the inside (on the inner side) of the fixing film 113, a heater unit 115 including a heating heater 111, a film guide 112, and the like is provided. The fixing film 113 and the heater unit 115 form the fixing film unit 15*a*. In the heater unit 115 of the present embodiment, the heating heater 111 is provided so as to be in direct rubbing with the base layer 113*a* at the portion at which the fixing film 113 form the fixing nip. Namely, with this configuration, a heat can be transferred efficiently from the inside of the fixing film 113 to the unfixed toner image on the recording material P passing through the fixing nip portion, so that the unfixed toner image on the recording material P can be thermally molten, and fixed. Incidentally, as the configuration of the heater unit 115, for example, it may be configured as follows: a heat transfer member or the like is interposed between the heating heater 111 and the fixing film 113, so that the heating heater 111 is not brought into direct contact with the inner surface of the fixing film 113.

The heating heater 111 includes a current carrying heat generating resistance layer formed along the longitudinal direction (the direction crossing with the sheet transport direction A) of a high thermal conductivity substrate formed of a ceramic material such as alumina or AlN, and is formed to be capable of generating heat by a current carrying portion not shown. Specifically, a current carrying heat generating resistance layer including a conductive agent such as Ag/Pd (silver palladium), Ni/Cr, $RuO_2$, $Ta_2N$, or $TaSiO_2$, and a matrix component such as glass or polyimide is formed by screen printing, vacuum evaporation, sputtering, plating, metal foil, or the like. Incidentally, the current carrying heat generating resistance layer is formed by coating in a linear or narrow band-like arc shape with a thickness of about 10 μm, and a width of about 1 mm to about 5 mm.

Then, the heating temperature by the heating heater 111 is detected by a temperature detecting portion 114 such as a thermistor, and is controlled so that the heating temperature may become a prescribed temperature. Further, on the current carrying heat generating resistance layer, an insulating protective layer of heat resistant glass, polyimide, polyamideimide, PEEK, or the like is formed. Further, the rubbing portion with the fixing film 113 in the heating heater 111 may be coated with PTFE (polytetrafluoroethylene), PFA (tetrafluoroethylene perfluoroalkyl vinyl ether copolymer), or the like, singly or in mixture. Alternatively, FEP (tetrafluoroethylene-hexafluoropropylene copolymer) or ETFE (ethylene-tetrafluoroethylene copolymer) may be coated. Further, a fluorine resin layer of CTFE (polychlorotrifluoroethylene), PVDF (polyvinylidene fluoride), or the like, or a resin such as polyimide or polyamideimide may be coated. Alternatively, a sliding layer formed by thinly applying or vacuum evaporating a dry coating film lubricant such as graphite or molybdenum disulfide, glass, DLC (diamond like carbon), or the like may be provided.

This enables the fixing film 113 and the heating heater 111 to slide at a low coefficient of friction. Further, the heating heater 111 made of a substrate with a high thermal conductivity may be configured to suppress the surface roughness at the surface sliding with the fixing film 113 to a prescribed surface roughness or lower, ensuring the slidability due to a lubricant grease, or the like, and suppress the heat resistance to a small heat resistance, thereby improving the thermal efficiency.

The heating heater 111 thus configured is held by a film guide 112. The film guide 112 has a function of preventing the heat generated from the heating heater 111 from being radiated in the opposite direction to the fixing nip portion. The film guide 112 is formed of a heat resistant resin such as a liquid crystal polymer (LCP), a phenol resin, PPS, or PEEK, and is situated such that the fixing film 113 fits thereon loosely with an allowance, and the fixing film 113 is rotatably guided in the direction of an arrow C in FIG. 3.

Further, the pressure roller 15*b* is provided with an elastic layer 122 formed by foaming preferably a heat resistant rubber such as silicone rubber or fluorocarbon rubber including a conductive member dispersed therein, or a silicone rubber on the outer side of a core metal 121 made of a metal such as SUS, SUM, or Al. Further, a release layer 123 of PFA, PTFE, FEP, or the like is formed on the outer side of the elastic layer 122. The pressure roller 15*b* is sufficiently pressurized from the opposite ends in the longitudinal direction, and is in pressure contact with the side of the fixing film 113 by a pressing unit such as a pressing spring not shown to form a fixing nip necessary for thermal fixing. Further, it is configured such that the ends in the longitudinal direction of the core metal 121 made of a metal of the pressure roller 15*b* are applied with a rotatory power of a driving unit not shown. As a result, the fixing film 113 loosely fits on the outer circumferential surface of the film guide 112 with an allowance, and rotates in a driven manner due to the frictional force with the outer circumferential surface of the rotating pressure roller 15*b*.

Further, in the present embodiment, a variable bias applying portion 116 as an applying unit for applying a fixing bias to the conductive primer layer 113*b* of the fixing film 113 for image formation is provided.

The variable bias applying portion 116 includes a negative electrode bias applying portion 116*b* for applying a negative direct current bias of the same polarity as that of the toner T which is the negative polarity of the present embodiment to the conductive primer layer 113*b*, and a positive electrode bias applying portion 116*a* for applying a positive direct current bias of the opposite polarity to that of the toner T. Further, the variable bias applying portion 116 has a bias switching unit SW1, and the like. When the bias switching unit SW1 switches the direct current bias (direct current voltage) to be applied to the conductive primer layer 113*b*, the bias switching unit SW1 can apply the bias by selectively switching between the positive electrode bias applying portion 116*a* and the negative electrode bias applying portion 116*b* by a control portion 130 described later. Incidentally, the switching timing of the bias application of the variable bias applying portion 116 will be described later.

Further, as shown in FIGS. 4A and 4B, the output end of the variable bias applying portion 116 and the conductive primer layer 113*b* are electrically connected with each other by a conductive brush 117 as a power feeding member. The conductive brush 117 is in contact with a portion 113*ba* not coated with the release layer 113*c* of the conductive primer layer 113*b* as shown in FIG. 4B. Incidentally, the fixing film 113 of FIGS. 4A and 4B is shown with an enlarged thickness for ease of understanding of the configuration. However, actually, the thickness is about 20 μm to about 100 μm. Further, in place of the conductive brush 117, a conductive rubber ring, a conductive cloth, a conductive contact segment, or the like may be used.

In FIG. 3, on the downstream side in a transport direction A of the recording material P from the fixing nip, a conductive discharge rubber roller (conductive member) 125 and a discharge roller 126 are arranged in a pair. These are a roller pair for interposing and transporting the sheet P discharged from the fixing nip portion. The conductive discharge rubber roller 125 is formed of a core metal 125*a* made of a metal such as aluminum, and a rubber layer 125*b* including a conductivity imparting member such as carbon black dispersed in a heat resistant rubber such as silicone rubber, formed on the outer circumference of the core metal 125*a*. The discharge rubber roller 125 has a conductivity with a resistivity of $1\times10^6\Omega$ or less.

Further, the discharge rubber roller 125 is arranged at a position with which the tip of the recording material P comes in contact when the recording material P is passing through the fixing nip. The discharge rubber roller 125 is grounded to E. For this reason, when the recording material P comes in contact with the discharge rubber roller 125 while passing through the fixing nip, the conductive primer layer 113*b* to be connected with the variable bias applying portion 116, the recording material P, and the discharge rubber roller 125 form a grounded current path. This causes a difference in electric potential between the conductive primer layer 113*b* of the fixing film 113 and the ground E.

Incidentally, in place of the discharge rubber roller 125, a conductive brush, a conductive guide, and the like grounded may be arranged on the downstream side in the transport direction of the recording material P of the fixing apparatus 15 to be brought into contact with the recording material P. Also in this case, a grounded current circuit is formed. For this reason, a difference in electric potential is caused between the conductive primer layer 113*b* of the fixing film 113 and the ground E. Therefore, the discharge rubber roller 125 is not required to be grounded in order to cause a difference in electric potential between the conductive primer layer 113*b* and the ground E.

The core metal 121 made of a metal of the pressure roller 15*b* is grounded to E via a resistance element 124. For this reason, the charge up of the pressure roller 15*b* can be prevented, and the electric potential of the surface of the pressure roller 15*b* can be stabilized. Accordingly, variations in difference in electric potential, and the like become less likely to be caused among the pressure roller 15*b*, the film unit 110, the discharge rubber roller 125, the discharge roller 126, and the like.

Further, a discharge sensor 127 for detecting the discharge of the recording material P from the fixing nip is provided between the fixing nip and the discharge rubber roller 125. Further, the image forming apparatus 100 shown in FIG. 1 is provided with a top sensor 108 (not shown) for detecting the tip of the recording material P to be transported.

The variable bias applying portion 116 is configured to switch the ON/OFF of application of a bias to the conductive primer layer 113*b* of the fixing film 113, and the application electrodes thereof by the control operation of a control portion 130 (not shown) as a control unit based on a signal from the top sensor 108 or the discharge sensor 127.

Fixing Bias Control

Table 5 shows the deposition confirmation results of filler/paper powder to the fixing member by fixing bias control with a conventional toner and an image forming apparatus of a conventional example.

First, the rows 1 and 2 of Table 5 show the results of feeding of a paper sheet using calcium carbonate as a filler, a so-called charcoal cal paper, and a paper sheet using talk as a filler, a so-called talk paper as a recording material when a negative toner is used. In the case of the row 1 or 2, the polarity of the unfixed toner is negative. For this reason, with the image forming apparatus of a conventional example, during feeding of the recording material to the fixing nip, the fixing member in contact with the toner is applied with a negative bias of the same polarity as that of the fixing bias. At the time of inter-paper period during which the recording material is not fed to the fixing nip, or other times, a positive bias of the opposite polarity to that of the unfixed toner is applied as the fixing bias.

When the recording material to be fed is charcoal cal paper (the row 1 of Table 5), although the tonner image is not offset during passing of the recording material through the fixing nip, the filler/paper powder charged to the opposite polarity to that of the toner is deposited on the fixing member. Further, during the inter-paper period during which the recording material does not pass through the fixing nip, or the like, the filler/paper powder charged to the opposite polarity to that of the toner is not deposited on the fixing member.

When the recording material is talk (the row 2 of Table 5), during passing of the recording material through the fixing nip, the filler/paper powder is negatively charged, and hence is not deposited on the fixing member, and the toner is also not deposited on the fixing member. During the inter-paper period during which the recording material does not pass through the fixing nip, or the like, a positive bias is applied thereto, and hence the negatively charged filler/paper powder is deposited on the fixing member.

In contrast, Table 6 shows the deposition confirmation results of filler/paper powder or the like to the fixing member when one example of fixing bias control with the toner and the image forming apparatus in the present Example is performed.

The rows 1 to 12 of Table 6 show the cases using a negative toner. A description will be given to the rows 1 to 6 of Table 6 using charcoal cal paper as a recording medium and using a negative toner. For the fixing bias control of the image forming apparatus of the present embodiment, when a filler/paper powder to be positively charged is fed, a positive bias of the same polarity as that of the filler/paper powder is applied during passing of the recording material through the fixing nip, and the inter-paper period during which the recording material does not pass, and the like. In this case, the positively charged filler/paper powder is not deposited on the fixing member during passing of the recording material through the fixing nip as well as during the inter-paper period during which the recording material does not pass.

Further, when the recording material passes through the fixing nip, the toner 6 of a conventional toner shows a small reduction of the volume resistivity at the fixing nip. For this reason, the decay of the electric charges of the negative polarity of the toner is small, so that a fixing bias of a positive polarity causes deposition to the fixing member, resulting in an offset image defect.

However, in each case using the toners 1 to 5 in Example of the present invention, the volume resistivity of the toner is largely reduced upon fixing, so that the electric charges of the toner also largely decay. For this reason, even when a bias of the opposite polarity to that of the unfixed toner image is applied, deposition onto the fixing member is not caused.

Then, a description will be given to the rows 7 to 12 of Table 6 using talk paper as the recording material, and using a negative toner. The filler/paper powder of talk paper is negatively charged. For this reason, for the fixing bias control of the image forming apparatus of the present embodiment, a negative bias of the same polarity as that of the filler/paper powder is applied as the fixing bias during passing of the recording material through the fixing nip, the inter-paper period during which the recording material does not pass, and the like. For this reason, the negatively charged filler/paper powder is not deposited on the fixing member.

With the toner 6 of a conventional toner, although the reduction of the volume resistivity of the toner upon fixing was small, and the decay of negative electric charges of the

TABLE 5

Confirmation of deposition of filler/paper powder to fixing member by fixing bias control with conventional toner and image forming apparatus of conventional example

| | | | During feeding of recording material to fixing nip | | | During inter-paper period | |
|---|---|---|---|---|---|---|---|
| | Charged polarity of | Charged polarity of | Fixing | Deposition to fixing member | | Fixing | Deposition to fixing member |
| Recording material | filler/paper powder | unfixed toner | bias Polarity | Toner | Filler/paper powder | bias Polarity | Filler/paper powder |
| 1 Charcoal cal paper | Positive | Negative | Negative | ○ | × | Positive | ○ |
| 2 Talk paper | Negative | Negative | Negative | ○ | ○ | Positive | × |

○: No deposition problem ×: Deposited toner was also small, a negative bias is applied as the fixing bias. For this reason, deposition on the fixing member was not observed.

With the toners 1 to 5 of the present Example, due to melting at the fixing nip portion, the volume resistivity of the toner was largely reduced, the decay of electric charges of the toner of a negative polarity was large, and the fixing bias was a negative bias. For these reasons, deposition on the fixing member was not observed.

TABLE 6

Confirmation of deposition of filler/paper powder to fixing member by fixing bias control with image forming apparatus of the present embodiment

| | Toner | Volume resistivity ratio Tv/Fv of toner before and after fixing | Recording material | Charged polarity of filler/paper powder | Charged polarity of unfixed toner | During feeding of recording material to fixing nip: Fixing bias Polarity | Deposition to fixing member: Toner | Deposition to fixing member: Filler/paper powder | During inter-paper period: Fixing bias Polarity | Deposition to fixing member: Filler/paper powder |
|---|---|---|---|---|---|---|---|---|---|---|
| 1 | Toner 1 | 12 | Charcoal cal paper | Positive | Negative | Positive | ○ | ○ | Positive | ○ |
| 2 | Toner 2 | 10 | Charcoal cal paper | Positive | Negative | Positive | ○ | ○ | Positive | ○ |
| 3 | Toner 3 | 9 | Charcoal cal paper | Positive | Negative | Positive | ○ | ○ | Positive | ○ |
| 4 | Toner 4 | 10 | Charcoal cal paper | Positive | Negative | Positive | ○ | ○ | Positive | ○ |
| 5 | Toner 5 | 8 | Charcoal cal paper | Positive | Negative | Positive | ○ | ○ | Positive | ○ |
| 6 | Toner 6 (Conventional toner) | 1.2 | Charcoal cal paper | Positive | Negative | Positive | × | ○ | Positive | ○ |
| 7 | Toner 1 | 12 | Talk paper | Negative | Negative | Negative | ○ | ○ | Negative | ○ |
| 8 | Toner 2 | 10 | Talk paper | Negative | Negative | Negative | ○ | ○ | Negative | ○ |
| 9 | Toner 3 | 9 | Talk paper | Negative | Negative | Negative | ○ | ○ | Negative | ○ |
| 10 | Toner 4 | 10 | Talk paper | Negative | Negative | Negative | ○ | ○ | Negative | ○ |
| 11 | Toner 5 | 8 | Talk paper | Negative | Negative | Negative | ○ | ○ | Negative | ○ |
| 12 | Toner 6 (Conventional toner) | 1.2 | Talk paper | Negative | Negative | Negative | ○ | ○ | Negative | ○ |

○: No deposition problem ×: Deposited

In the present embodiment, the polarity of the fixing bias is not switched between during feeding of the recording material to the fixing nip and during the inter-paper period. For this reason, the fixing bias is not switched in the inter-paper period as with a conventional image forming apparatus. Therefore, the fixing bias switching time in the inter-paper period does not matter. For this reason, this embodiment is also applicable to an image forming apparatus having an inter-paper period distance as small as about 10 mm. Further, the fixing bias is not switched between during passing of the recording material through the fixing nip and during the inter-paper period. For this reason, the number of times of switching the fixing bias polarity can be reduced as compared with a conventional image forming apparatus, so that the wear of the fixing member surface layer can be reduced to extend the life.

In the description up to this point, although a description has been given to the case where a toner of negative polarity as the charged polarity of the toner is used, the charge control agent of the toner may be changed, and a toner having positively charging characteristics may be used. As an image forming apparatus, not a monochrome printer, but a color printer may be used.

Although the case of a fixing member as a member for applying a fixing bias has been described, a fixing bias may be applied to the pressure member side so as to generate an electric field under which the charged filler/paper powder is pressed against the recording material side. Although a fixing apparatus of a film heating system has been described as a fixing apparatus, a fixing apparatus of another fixing system (such as a roller fixing system or a belt fixing system) may be used. Although a ceramic heater has been described as a heating member of a fixing apparatus, another heating system (such as a halogen heater or an electromagnetic induction heating) may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-132155, filed on Aug. 4, 2020, which is hereby incorporated by reference herein in its entirety.

What is claimed is:

1. An image forming apparatus comprising:

an image forming portion for forming an unfixed developer image on a recording material using a developer;

a fixing portion having a fixing member, and a pressure member for coming in pressure contact with the fixing member, and forming a fixing nip portion, the fixing portion passing the recording material through the fixing nip portion, and fixing the developer image on the recording material; and a bias applying unit for applying a bias to at least one of the fixing member and the pressure member;

wherein the fixing member has a surface layer having conductivity, wherein the developer is a toner having a toner particle including a binder resin, a reactant of a polyhydric acid and a compound containing a group 4 element is present on a surface of the toner particle, and Tv/Fv>100 is satisfied where Tv represents a volume resistivity upon being unfixed, and Fv represents a volume resistivity after fixing, and wherein the bias applying unit can selectively apply a bias of a positive polarity and a bias of a negative polarity, and applies a bias of the same polarity as the charged polarity of a filler included in the recording material when the recording material passes through the fixing nip portion, and when the recording material does not pass through the fixing nip portion, respectively.

2. The image forming apparatus according to claim 1, wherein the bias applying unit applies a bias of the opposite polarity to the charged polarity of the developer when the recording material passes through the fixing nip portion in the case where the charged polarity of the developer and the charged polarity of the filler included in the recording material are different polarities.

3. The image forming apparatus according to claim 1, wherein the toner particle has a toner base particle including the binder resin, and a protruded portion of the toner base particle surface, and the protruded portion includes an organosilicon polymer.

4. The image forming apparatus according to claim 3, wherein the toner particle has the reactant of a polyhydric acid and a compound containing a group 4 element on the surface of the protruded portion.

5. The image forming apparatus according to claim 3, wherein the organosilicon polymer has a structure expressed by the following expression (II):

$$R—SiO_{3/2} \quad (II)$$

(in the expression (II), R represents an alkyl group, an alkenyl group, an acyl group, an aryl group, or a methacryloxyalkyl group).

6. The image forming apparatus according to claim 5, wherein the R is an alkyl group, a vinyl group, a phenyl group, or a methacryloxypropyl group having at least 1 and not more than 6 carbon atoms.

7. The image forming apparatus according to claim 1, wherein the toner has fine particles with a number-average particle diameter of at least 50 nm and not more than 500 nm on the toner particle surface.

8. The image forming apparatus according to claim 7, wherein the fine particle is a fine particle including silicon.

9. The image forming apparatus according to claim 7, wherein the fine particle is a silica fine particle.

10. The image forming apparatus according to claim 1, wherein the fixing member is a film in a tubular shape having flexibility with whose outer surface the pressure member comes in contact, and wherein the fixing portion further has a heater, and the pressure member forms the fixing nip portion with the heater via the film.

* * * * *